US011312150B2

(12) United States Patent
Moriwaki

(10) Patent No.: US 11,312,150 B2
(45) Date of Patent: Apr. 26, 2022

(54) LIQUID SURFACE IMAGING DEVICE AND LIQUID DISCHARGE APPARATUS

(71) Applicant: RICOH COMPANY, LTD., Tokyo (JP)

(72) Inventor: Yuta Moriwaki, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/984,712

(22) Filed: Aug. 4, 2020

(65) Prior Publication Data

US 2021/0060968 A1 Mar. 4, 2021

(30) Foreign Application Priority Data

Sep. 4, 2019 (JP) ..... JP2019-161207

(51) Int. Cl.

| | |
|---|---|
| ***B41J 2/175*** | (2006.01) |
| ***B41J 11/00*** | (2006.01) |
| ***B41J 2/01*** | (2006.01) |
| *B41J 2/165* | (2006.01) |

(52) U.S. Cl.

CPC ..... *B41J 2/17596* (2013.01); *B41J 2/01* (2013.01); *B41J 11/00214* (2021.01); *B41J 11/00218* (2021.01); *B41J 2002/16597* (2013.01)

(58) Field of Classification Search

CPC ..... B41J 2/17596; B41J 2/16535; B41J 2/16585; B41J 2/16579; B41J 2002/16597; B41J 2025/008; B41J 2/01; B41J 11/00214; B41J 11/00218

See application file for complete search history.

(56) References Cited

U.S. PATENT DOCUMENTS

| | | | |
|---|---|---|---|
| 2013/0194346 | A1 | 8/2013 | Moriwaki |
| 2014/0009531 | A1 | 1/2014 | Kaneko et al. |
| 2014/0063121 | A1 | 3/2014 | Moriwaki et al. |
| 2014/0152745 | A1 | 6/2014 | Park |
| 2014/0265106 | A1 | 9/2014 | Saitoh et al. |
| 2015/0077478 | A1 | 3/2015 | Kawabata et al. |
| 2016/0129693 | A1 | 5/2016 | Moriwaki et al. |
| 2017/0106655 | A1 | 4/2017 | Moriwaki et al. |
| 2018/0147854 | A1 | 5/2018 | Yoshida et al. |
| 2018/0339519 | A1 | 11/2018 | Katoh et al. |
| 2018/0370245 | A1 | 12/2018 | Moriwaki |
| 2019/0232676 | A1 | 8/2019 | Kubodera et al. |

FOREIGN PATENT DOCUMENTS

| | | |
|---|---|---|
| JP | 2013-052616 | 3/2013 |

*Primary Examiner* — Anh T Vo
(74) *Attorney, Agent, or Firm* — Xsensus LLP

(57) ABSTRACT

A liquid surface imaging device includes an irradiator including a plurality of lightings, the irradiator configured to irradiate a liquid surface in a nozzle of a liquid discharge head with lights emitted from the plurality of lightings, and an imaging device configured to image the liquid surface. The plurality of lightings is arranged point-asymmetrically with a center of the imaging device as a point of symmetry.

20 Claims, 20 Drawing Sheets

LIQUID SURFACE IMAGING DEVICE AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-161207, filed on Sep. 4, 2019, in the Japan Patent Office, the entire disclosures of which is hereby incorporated by reference herein.

BACKGROUND

Technical Field

Aspects of the present disclosure relate to a liquid surface imaging device and a liquid discharge apparatus.

Related Art

In a nozzle from which a liquid is discharged, a state of a liquid surface of the liquid in the nozzle affects discharge characteristics of a liquid discharge head that includes the nozzle to discharge the liquid.

A method to detect a nozzle state of the liquid discharge head includes a step that applies a first drive voltage to an actuator to discharge a first droplet, a step that applies a second drive voltage to the actuator to discharge a second droplet in a state in which meniscus formed in the nozzle is protrude in a direction toward the nozzle opposite to a liquid chamber after the first droplet is discharged from the nozzle, and a step that detects a discharge direction of the second droplet from the nozzle with a discharge direction detector.

SUMMARY

In an aspect of this disclosure, a liquid surface imaging device includes an irradiator including a plurality of lightings, the irradiator configured to irradiate a liquid surface in a nozzle of a liquid discharge head with lights emitted from the plurality of lightings, and an imaging device configured to image the liquid surface. The plurality of lightings is arranged point-asymmetrically with a center of the imaging device as a point of symmetry.

In another aspect of this disclosure, a liquid surface imaging device includes an irradiator including a plurality of lightings, the irradiator configured to irradiate a liquid surface in a nozzle of a liquid discharge head with lights emitted from the plurality of lightings, and an imaging device configured to image the liquid surface. The plurality of lightings is arranged point-symmetrically with a center of the imaging device as a point of symmetry, and the irradiator individually turns off a part of the plurality of lightings and turns on the other part of the part of the plurality of lightings to image the liquid surface with imaging device.

In still another aspect of this disclosure, a liquid surface imaging device includes an irradiator including a belt-shaped lighting, the irradiator configured to irradiate a liquid surface in a nozzle of a liquid discharge head with light emitted from the belt-shaped lighting, and an imaging device configured to image the liquid surface. The belt-shaped lighting is arranged point-asymmetrically around a center of the imaging device as a point of symmetry.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1A:
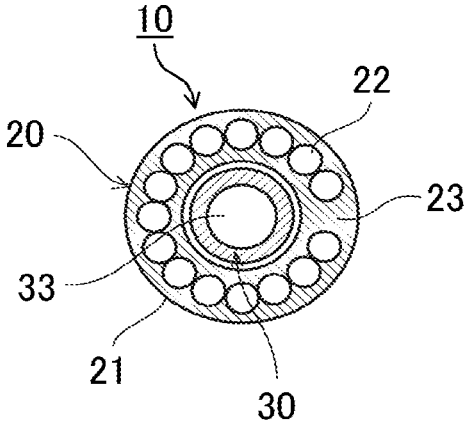
FIGS. 1A and 1B are schematic plan view and side view, respectively, of a liquid surface imaging device according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Figure 1B:
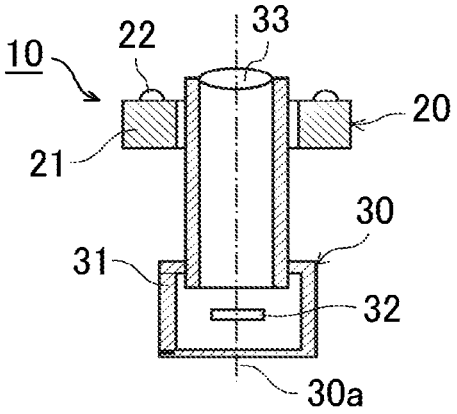
Figure 2:
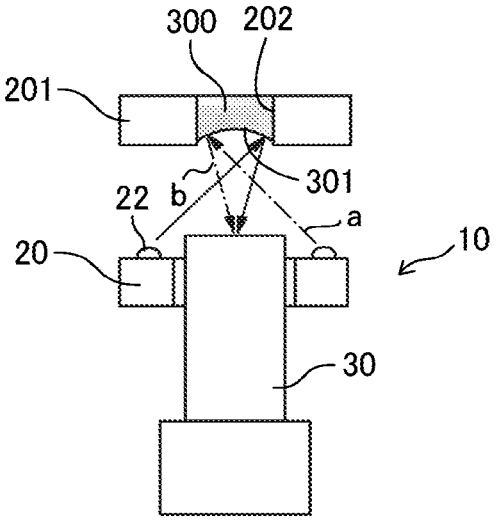
FIG. 2 is a schematic cross-sectional front view of the liquid surface imaging device when the liquid surface imaging device images a liquid surface in a nozzle of a liquid discharge head.

Embodiments of the present disclosure are described below with reference to the attached drawings. Next, a first embodiment of the present disclosure is described with reference to FIGS. 1 and 2. FIG. 1A is a schematic plan view of a liquid surface imaging device 10 according to the first embodiment of the present disclosure. FIG. 1B is a schematic cross-sectional front view of the liquid surface imaging device 10 of FIG. 1 according to the first embodiment of the present disclosure. FIG. 2 is a schematic cross-sectional front view of the liquid surface imaging device 10 when the liquid surface imaging device 10 images a liquid surface in the nozzle of a liquid discharge head.

The liquid surface imaging device 10 includes an irradiator 20 and an imaging device 30. The irradiator 20 includes a plurality of lightings 22 to irradiate a liquid surface 301 (meniscus surface) of a liquid 300 held inside a nozzle 202. The nozzle 202 is formed in a nozzle plate 201 (see FIG. 2) of a liquid discharge head 200 (see FIG. 31). The imaging device 30 images the liquid surface 301 of the liquid 300 in the nozzle 202. Hereinafter, the liquid discharge head 200 is simply referred to as a "head 200."

The irradiator 20 includes the plurality of lightings 22 that are arranged annularly in a holder 21. The plurality of lightings 22 includes an absence portion 23 (notched portion) in which a part of the plurality of the lightings 22 (one lighting in FIG. 1A) is absent (not arranged). For example, one lighting 22 is absent (not existed) in the absence portion 23 in FIG. 1A.

However, two or more lightings 22 may be absent (not existed) in the absent portion. The plurality of lightings 22 is arranged point-asymmetrically with a center 30*a* (optical axis) as a point (center) of symmetry when the imaging device 30 is viewed in an imaging direction (viewed in a vertical direction from above in FIG. 1B). If the imaging device 30 includes a lens 33, the center 30*a* can also be referred to as "a symmetry axis passing through a center of the lens 33 (optical imaging system)".

The plurality of lightings 22 is a part that is turned on. The plurality of lightings 22 may include light sources such as light emitting diodes (LEDs). As illustrated in FIG. 1B, the plurality of lightings 22 may include light emitting diodes (LEDs) having hemispherical shape, for example. Alternatively, the plurality of lightings 22 may include a lens, a mirror, a prism, an optical fiber, or the like to transmit light emitted from the separately arranged light source to the plurality of lightings 22.

Particularly, the liquid surface imaging device 10 has a configuration in which the light emitted from the light source is transmitted to the plurality of lightings 22 via the mirror. Thus, the liquid surface imaging device 10 can prevent the liquid dropped from the head 200 from attaching the irradiator 20 and the imaging device 30.

The imaging device 30 includes an imaging element 32 and a lens 33. The imaging element 32 is arranged inside a housing 31 and images the liquid surface 301. The lens 33 is arranged on a front surface (upper surface in FIG. 1B) of the housing 31 to collect lights reflected from the liquid surface 301 (see FIG. 2).

Figure 3A:
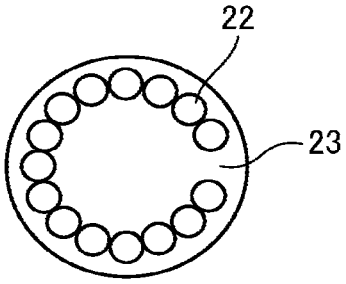
FIGS. 3A to 3C are schematic plan views of imaging results imaged by the liquid surface imaging device to illustrate an operation of the liquid surface imaging device according to the first embodiment of the present disclosure.
Figure 3B:
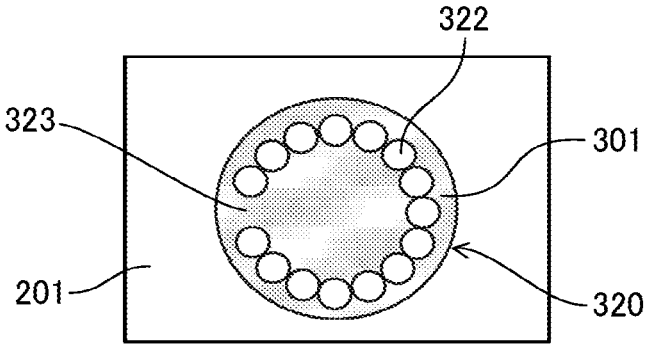
Figure 3C:
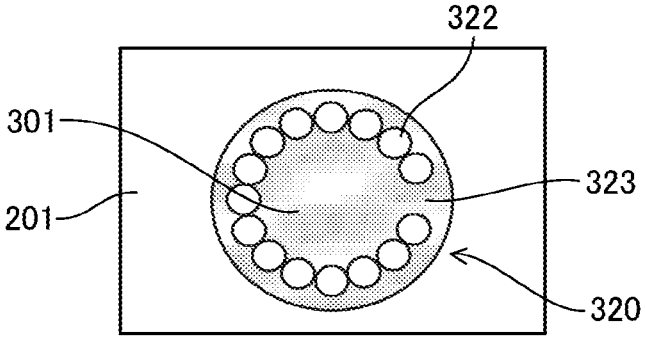

Next, an operation of the liquid surface imaging device 10 is described with reference to FIGS. 3A to 3C. FIGS. 3A to 3C are schematic plan views of imaging results imaged by the liquid surface imaging device 10 to illustrate the operation of the liquid surface imaging device 10 according to the first embodiment. In the imaging results illustrated in FIGS. 3B and 3C, the same reference numerals with reference numerals in the imaging object (target) are used for the nozzle plate 201 and the liquid surface 301. Hereinafter, the same reference numerals are used.

The liquid surface imaging device 10 faces the liquid surface 301 in the nozzle 202 as illustrated in FIG. 2 to image the liquid surface 301 in the nozzle 202. However, the liquid surface imaging device 10 is not necessarily to face the liquid surface 301 to image the liquid surface 301.

The liquid surface imaging device 10 turns on the plurality of lightings 22 of the irradiator 20 to irradiate (illuminates) the liquid surface 301 with light "a" (see FIG. 2) emitted from the plurality of lightings 22. A reflected light "b" (see FIG. 2) enters the imaging element 32 via the lens 33 of the imaging device 30 (see FIG. 1B). A number, shape, and presence or absence of the lens 33 may be selected as appropriate.

For example, as illustrated in FIG. 3A, the liquid surface imaging device 10 turns on the plurality of lightings 22 that is arranged annularly. The plurality of lightings 22 includes the absence portion 23 in a part (right side in FIG. 3A) of the plurality of lightings 22. Thus, as illustrated in FIG. 3B, the liquid surface imaging device 10 can obtain an image 320 including an optical image 322 corresponding to the plurality of lightings 22 on the liquid surface 301. The image 320 is an image when the liquid surface 301 has a concave shape. As illustrated in FIGS. 3A and 3B, an absence portion 323 (left side in FIG. 3B) in the image 320 is disposed opposite (inverted) to the absence portion 23 of the irradiator 20 (right side in FIG. 3A).

A shape and a size of the optical image 322 in the image 320 change according to a shape and a curvature of the liquid surface 301, a state of the liquid surface 301 such as a solidification of the liquid 300 around a periphery of the nozzle 202.

Thus, the liquid surface imaging device 10 according to the ninth embodiment can obtain the image 320 with the imaging device 30 to observe and grasp the state of the liquid surface 301.

Further, the plurality of lightings 22 is arranged point-asymmetrically with the center 30*a* (optical axis) of the imaging device 30 as the point (center) of symmetry according to the first embodiment of the present disclosure (see FIGS. 1B and 3A). That is, the plurality of lightings 22 includes the absence portion 323.

Therefore, the absence portion 323 in the image 320 imaged by the imaging device 30 is disposed opposite to the absence portion 23 of the irradiator 20 as illustrated in FIGS. 3A and 3B when the liquid surface 301 has a concave shape. Conversely, when the liquid surface 301 has a convex shape, the absence portion 23 of the irradiator 20 and the absence portion 323 in the image 320 are disposed at the same side (right side in FIGS. 3A and 3C) as illustrated in FIG. 3C.

Note that the observed phenomenon may be reversed depending on an arrangement of the lens 33 and the imaging device 30, and an image processing method, and the like. That is, there is a case in which the image is inverted when the liquid surface 301 has a convex shape, and the image is not inverted when the liquid surface 301 has a concave shape. Even in an above-described case, the liquid surface imaging device 10 can observe the state of the liquid surface 301 and determine an abnormality of the liquid surface 301.

Thus, the liquid surface imaging device 10 can determine whether a shape of the liquid surface 301 is concave or convex from the position of the absence portion 323 in the image 320. The head 200 cannot perform a normal discharge operation when the liquid surface 301 has a convex shape as illustrated in the liquid surface 301B in FIG. 4(*b*).

Figure 4:
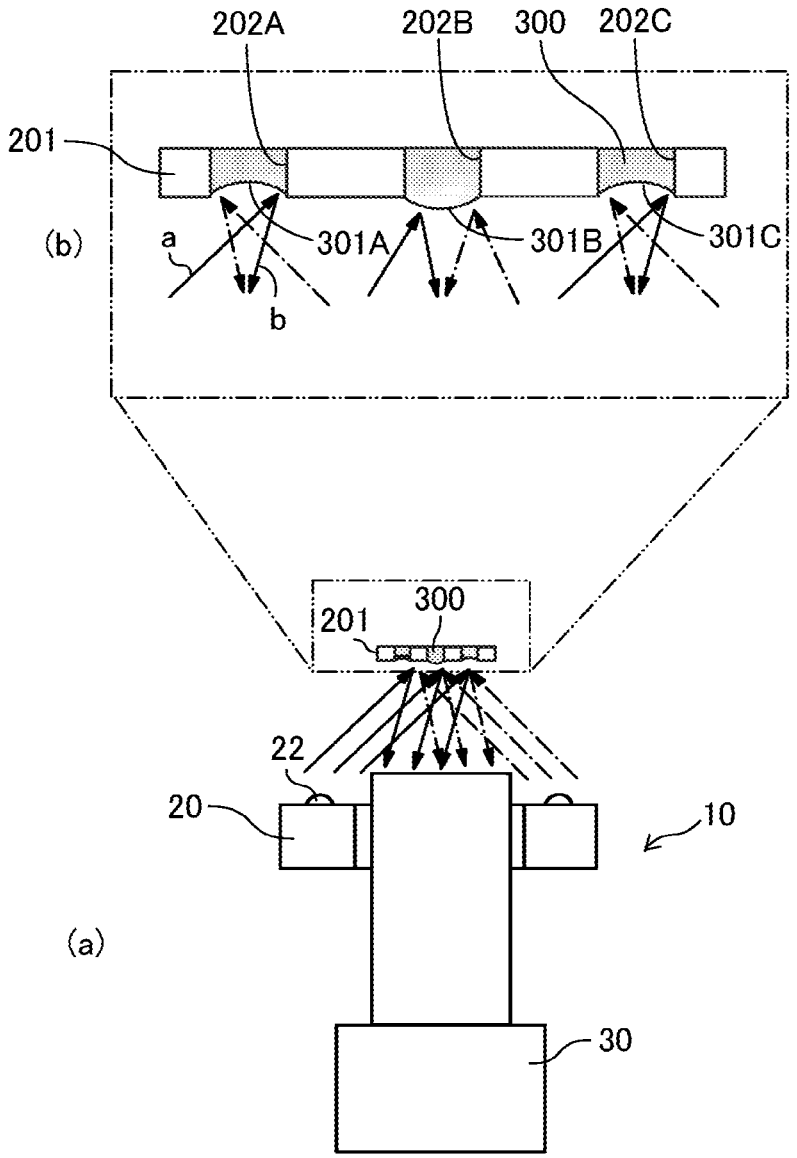
FIG. 4 is a cross-sectional view of the liquid discharge head and the liquid surface imaging device to illustrate an operation of the liquid surface imaging device when a nozzle plate of the liquid discharge head includes a plurality of nozzles.

Next, an imaging operation for the head 200 including the nozzle plate 201 that includes a plurality of nozzles 202 is described with reference to FIGS. 4 and 5. FIG. 4 is a schematic cross-sectional front view of the head 200 and the liquid surface imaging device 10 illustrating the imaging operation. FIG. 5 is a schematic plan view of different imaging results of FIG. 4.

As illustrated in FIG. 4(*a*), the plurality of lightings 22 of the irradiator 20 of the liquid surface imaging device 10 emits the lights "a" so that the liquid surfaces 301A to 301C in the nozzles 202A to 202C, respectively, are irradiated with the lights "a" as illustrated in FIG. 4(*b*). The reflected lights "b" reflected from each of the liquid surfaces 301A to 301C enter the imaging element 32 of the imaging device 30.

Figure 5A:
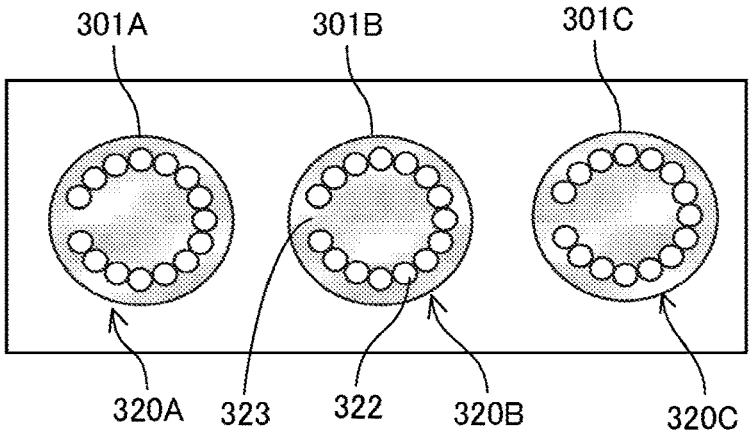
FIGS. 5A and 5B are schematic plan views of different imaging results of FIG. 4.

If the liquid surfaces 301A to 301C in three nozzles 202A to 202C are all concave shape (see liquid surfaces 301A and 301C in FIG. 4(*b*)), all of the absence portions 323 in the images 320A to 320C are disposed opposite to the absence portion 23 (see FIG. 1A) of the irradiator 20 as illustrated in FIG. 5A. The position of the absence portions 323 in the images 320A to 320C are at the same side (left side) in FIG. 5A.

Figure 5B:
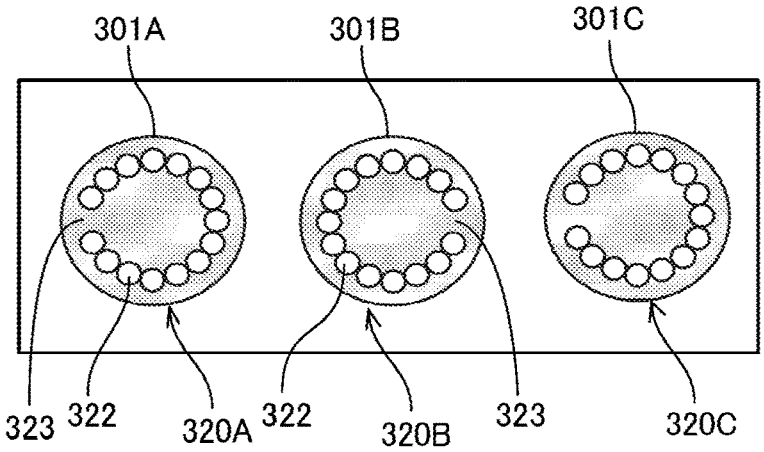

Conversely, if the liquid surface 301B of the nozzle 202B in the middle of the nozzles 202A to 202C is a convex shape (see liquid surface 301B in FIG. 4(*b*)), the absence portion 323 in the image 320B and the absence portion 23 (see FIG. 1A) of the irradiator 20 are disposed at the same side (right side) as illustrated in FIG. 5B. The position of the absence portion 323 in the image 320B (right side) is different from the positions of the absence portions 323 in the images 320A and 320C (left side) in FIG. 5B.

Thus, the liquid surface imaging device 10 according to the first embodiment is used to enable imaging and observation of the state of the liquid surface 301 in the plurality of nozzles 202 at one time.

Figure 6:
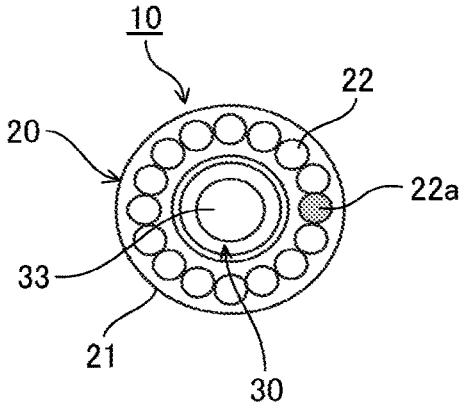
FIG. 6 is a schematic plan view of the liquid surface imaging device according to a second embodiment of the present disclosure.

Next, a second embodiment of the present disclosure is described with reference to FIG. 6. FIG. 6 is a schematic plan view of the liquid surface imaging device 10 according to the second embodiment of the present disclosure.

The irradiator 20 of the liquid surface imaging device 10 according to the second embodiment includes the plurality of lightings 22 that is arranged annularly. Further, a part of the plurality of lightings 22 can be individually turned off. The part of the plurality of lightings 22 is also referred to as a "lighting 22*a*" in FIG. 6. The irradiator 20 include one lighting 22*a* (right side) in FIG. 6. However, the irradiator 20 may include two or more of the lightings 22*a*.

Thus, the irradiator 20 turns off the lighting 22*a* to make the plurality of lightings 22 other than the lighting 22*a* to be arranged point-asymmetrically with the center 30*a* (optical axis) of the imaging device 30 as the point (center) of symmetry according to the second embodiment of the present disclosure (see FIG. 6).

According to such a configuration in FIG. 6, the liquid surface imaging device 10 according to the second embodiment can obtain the same functional effect as a functional effect of the first embodiment. Further, the liquid surface imaging device 10 according to the second embodiment can choose between a state including the absence portion 23 of the first embodiment by turning off the lighting 22*a* and a state including the plurality of lightings 22 that is annually arranged without the absence portion 23 by turning on all the plurality of lightings 22 including the lighting 22*a*.

Further, the irradiator 20 in the first embodiment is difficult to obtain meniscus information of the absence portion 23. The irradiator 20 in the first embodiment does not include the lighting 22*a* in the absence portion 23 and includes the plurality of lightings 22 that is point-asymmetrically arranged. However, the irradiator 20 in the second embodiment can turn on and turn off the lighting 22*a* so that the liquid surface imaging device 10 can obtain full information of the meniscus in the nozzles 202 including the meniscus information of the absence portion 23 without defect.

Figure 7A:
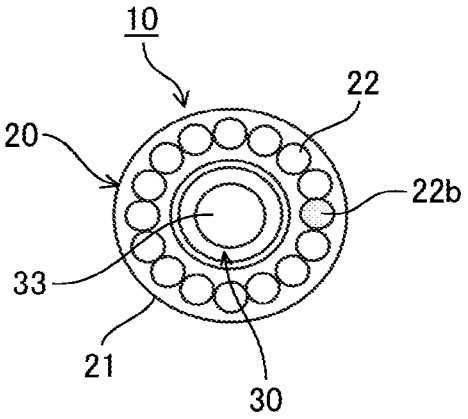
FIGS. 7A and 7B are schematic plan views of different examples of an irradiator of the liquid surface imaging device according to a third embodiment of the present disclosure.
Figure 7B:
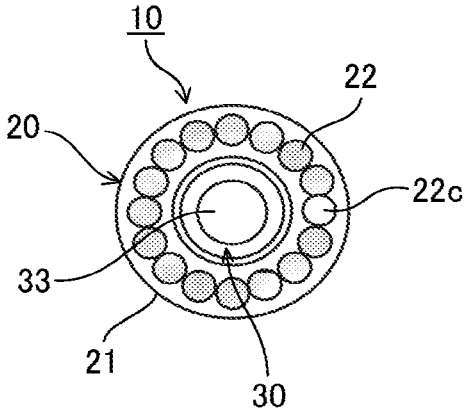

Next, a different example of the liquid surface imaging device 10 in a third embodiment of the present disclosure is described with reference to FIGS. 7A and 7B. FIGS. 7A and 7B are plan views of the liquid surface imaging device 10 according to the third embodiment of the present disclosure.

The irradiator 20 of the liquid surface imaging device 10 according to the second embodiment includes the plurality of lightings 22 that is arranged annularly. The irradiator 20 can turns on a part of the plurality of lightings 22 such that a light emission intensity of the part of the plurality of the lightings 22 is made different from light emission intensities of the other part of the plurality of lightings 22. The part of the plurality of lightings 22 is referred to as "lighting 22*b*" and "lighting 22*c*" in FIG. 7A and FIG. 7B, respectively.

Thus, the irradiator 20 turns on the lighting 22*b* to make other lightings 22, having substantially the same light emission intensity, to be arranged point-asymmetrically with the center 30*a* (optical axis) of the imaging device 30 as the point (center) of symmetry.

In an example illustrated in FIG. 7A, a light emission intensity of the lighting 22*b* is weaker than a light emission intensity of each of other lightings 22. In an example illustrated in FIG. 7B, the light emission intensity of the lighting 22*c* is stronger than the light emission intensity of each of the other lightings 22.

According to such a configuration in FIG. 6, the liquid surface imaging device 10 according to the second embodiment can obtain the same functional effect as a functional effect of the first embodiment. Further, the irradiator 20 in the first embodiment is difficult to obtain meniscus information of the absence portion 23. The irradiator 20 in the first embodiment does not include the lighting 22*a* in the absence portion 23 and includes the plurality of lightings 22 that is point-asymmetrically arranged.

However, the irradiator 20 in the third embodiment can turn on and turn off the lighting 22*b* or 22*c* with the light emission intensity different from the light emission intensities of other lightings 22 so that the liquid surface imaging device 10 can obtain full information of the meniscus in the nozzles 202 including the meniscus information of the absence portion 23 without defect.

Figure 8:
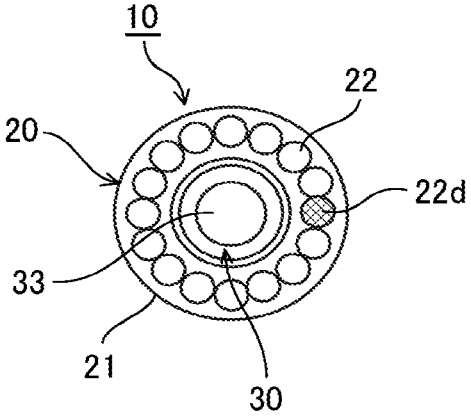
FIG. 8 is a schematic plan view of different examples of the irradiator of the liquid surface imaging device according to a fourth embodiment of the present disclosure.
Figure 9A:
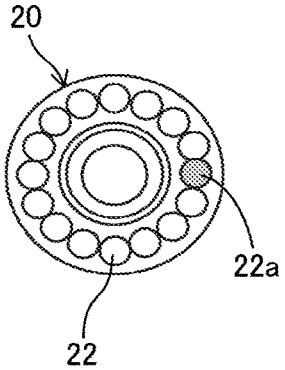
FIGS. 9A to 9D are schematic plan views of the liquid surface imaging device according to a fifth embodiment of the present disclosure.
Figure 9B:
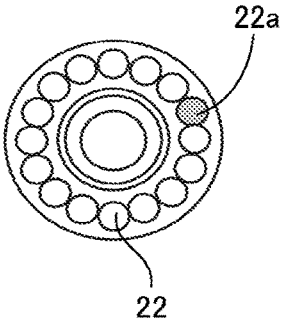
Figure 9C:
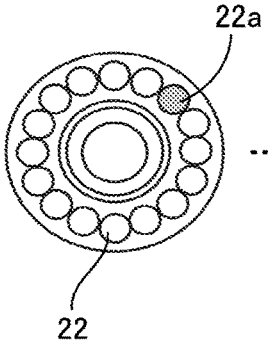
Figure 9D:
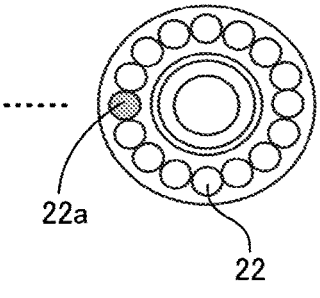
Figure 10A:
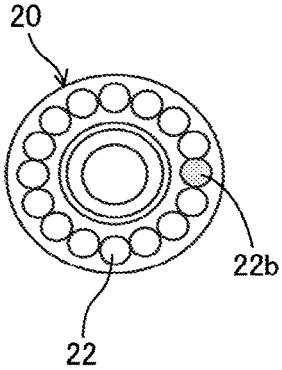
FIGS. 10A to 10D are schematic plan views of the liquid surface imaging device according to a sixth embodiment of the present disclosure.
Figure 10B:
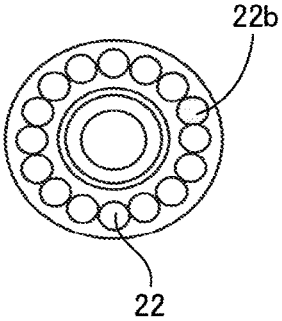
Figure 10C:
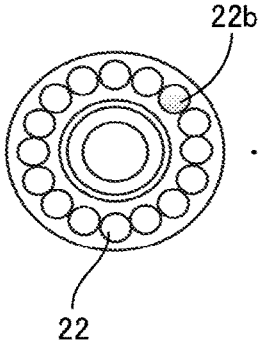
Figure 10D:
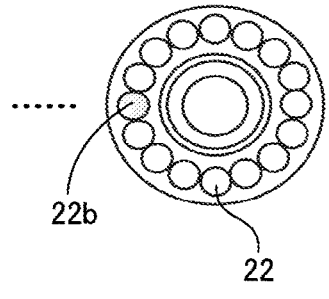

Next, a fourth embodiment of the present disclosure is described with reference to FIG. 8. FIG. 8 is a schematic plan view of the liquid surface imaging device 10 according to the fourth embodiment of the present disclosure.

The irradiator 20 of the liquid surface imaging device 10 according to the second embodiment includes the plurality of lightings 22 that is arranged annularly. The irradiator 20 can turns on a part of the plurality of lightings 22 such that a light emission color of the part of the plurality of the lightings 22 is different from a light emission color of the other part of the plurality of lightings 22. The part of the plurality of lightings 22 is referred to as "lighting 22*d*" in FIG. 8. The light emission color of the other part of the plurality of lightings 22 is the same color.

Thus, the irradiator 20 turns on the lighting 22*d* to emit light, the light emission color of which is different from the light emission color of the other part of the plurality of lightings 22. Thus, the other part of the plurality of lightings 22 that emit substantially the same light emission color are arranged point-asymmetrically with the center 30*a* (optical axis) of the imaging device 30 as the point (center) of symmetry.

Further, the irradiator 20 in the first embodiment is difficult to obtain meniscus information of the absence portion 23. The irradiator 20 in the first embodiment does not include the lighting 22*a* in the absence portion 23 and includes the plurality of lightings 22 that is point-asymmetrically arranged. However, the irradiator 20 in the fourth embodiment can turn on and turn off the lighting 22*c* with the light emission color different from the light emission color of other lightings 22 so that the liquid surface imaging device 10 can obtain full information of the meniscus in the nozzles 202 including the meniscus information of the absence portion 23 without defect.

Next, a fifth embodiment of the present disclosure is described with reference to FIGS. 9A to 9D. FIGS. 9A to 9D are schematic plan views of the liquid surface imaging device 10 according to the fifth embodiment of the present disclosure.

The liquid surface imaging device 10 according to the fifth embodiment can select a lighting 22*a* to be turned off from any of the plurality of lightings 22 that is arranged annularly as illustrated in FIGS. 9A to 9D. The fifth embodiment illustrated in FIGS. 9A to 9D is similar to the second embodiment illustrated in FIG. 6 to have the lighting 22*a* to be turned off. However, the fifth embodiment can change the position of the lighting 22*a* whereas the position of the lighting 22*a* in the second embodiment is fixed.

A sixth embodiment according to the present disclosure is described with reference to FIGS. 10A to 10D. FIGS. 10A to 10D are schematic plan views of the liquid surface imaging device 10 according to the sixth embodiment of the present disclosure.

The liquid surface imaging device 10 according to the sixth embodiment can select a lighting 22*a*, the light emission intensity of which is reduced, from any of the plurality of lightings 22 that is arranged annularly as illustrated in FIGS. 10A to 10D. The sixth embodiment illustrated in FIGS. 10A to 10D is similar to the third embodiment illustrated in FIG. 7A to have the lighting 22*b*, the light emission intensity of which is reduced. However, the sixth embodiment can change the position of the lighting 22*b* whereas the position of the lighting 22*b* in the third embodiment is fixed.

Figure 11:
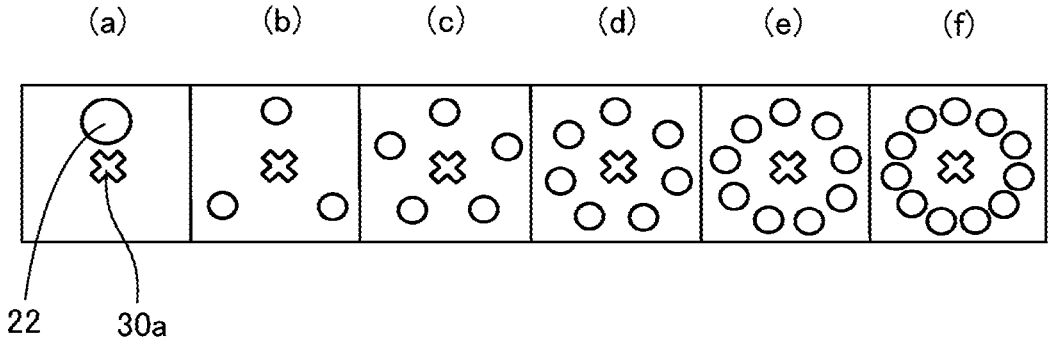
FIG. 11 is a schematic plan view of different examples of the irradiator of the liquid surface imaging device according to a seventh embodiment of the present disclosure.

Next, a different example of the liquid surface imaging device 10 in a seventh embodiment of the present disclosure is described with reference to FIG. 11. FIG. 11 is a schematic plan view of different examples of the liquid surface imaging device 10 according to the seventh embodiment of the present disclosure.

A first example illustrated in FIG. 11(*a*) is an example including one lighting 22. When a number of the lighting 22 is one, the lighting 22 is arranged point-asymmetrically with the center 30*a* (optical axis) of the imaging device 30 even if the center 30*a* is at any position in the liquid surface imaging device 10. In FIG. 11(*a*), the center 30*a* is at the center of the liquid surface imaging device 10.

In a second example to a sixth example respectively illustrated in FIG. 11(*b*) to 11(*f*), the plurality of lightings 22 is arranged in a polygonal shape. The plurality of lightings 22 has angles and vertices that are arranged point-asymmetrically with the center 30*a* of the imaging unit 30 as the point (center) of symmetry. The plurality of lightings 22 is arranged in a triangle in the second example in FIG. 11(*b*). The plurality of lightings 22 is arranged in a pentagon in the third example in FIG. 11(*c*). The plurality of lightings 22 is arranged in a heptagon in the fourth example in FIG. 11(*d*). The plurality of lightings 22 is arranged in an enneagon in the fifth example in FIG. 11(*e*). The plurality of lightings 22 is arranged in a hendecagon in the sixth example in FIG. 11(*f*).

Figure 12:
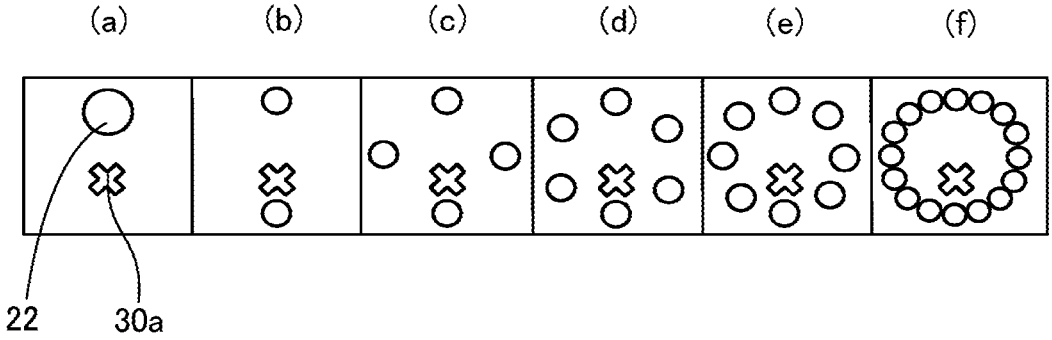
FIG. 12 is a schematic plan view of different examples of the irradiator of the liquid surface imaging device according to an eighth embodiment of the present disclosure.

Next, a different example of the liquid surface imaging device 10 in an eighth embodiment of the present disclosure is described with reference to FIG. 12. FIG. 12 is a schematic plan view of different examples of the liquid surface imaging device 10 according to the eighth embodiment of the present disclosure.

A first example illustrated in FIG. 12(*a*) is an example including one lighting 22. When a number of the lighting 22 is one, the lighting 22 is arranged point-asymmetrically with the center 30*a* (optical axis) of the imaging device 30 even if the center 30*a* is at any position in the liquid surface imaging device 10. In FIG. 12(*a*), the center 30*a* is at a position lower than the center of the liquid surface imaging device 10.

In a second example to a sixth example respectively illustrated in FIGS. 12(*b*) to 12(*f*), the plurality of lightings 22 is arranged in a polygonal shape having a point of symmetry (symmetry point). However, in each of the second example to the sixth example, the point of symmetry of the plurality of lightings 22 is shifted from the center 30*a* of the imaging device 30. Further, the plurality of lightings 22 is arranged point-asymmetrically with the center 30*a* (optical axis) of the imaging device 30 as the point of symmetry.

Two lightings 22 are arranged in the second example in FIG. 12(*b*). Four lightings 22 are arranged in a tetragon in the third example in FIG. 12(*c*). Six lightings 22 are arranged in a hexagon in the fourth example in FIG. 12(*d*). Eight lightings 22 are arranged in an octagon in the fifth example in FIG. 12(*e*). Ten lightings 22 are arranged in a decagon in the sixth example in FIG. 12(*f*).

Figure 13A:
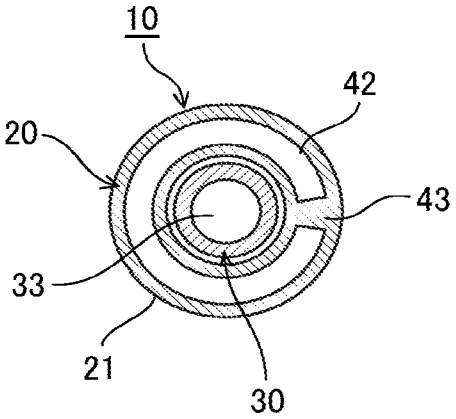
FIGS. 13A and 13B are schematic plan view and side view, respectively, of the liquid surface imaging device according to a ninth embodiment of the present disclosure.
Figure 13B:
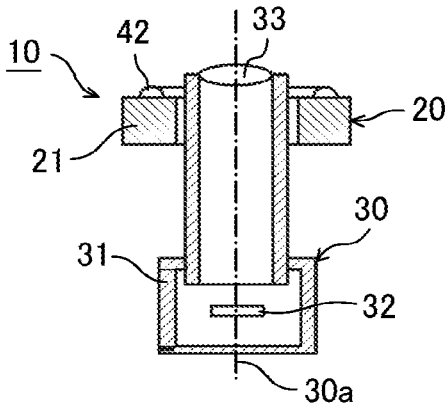
Figure 14:
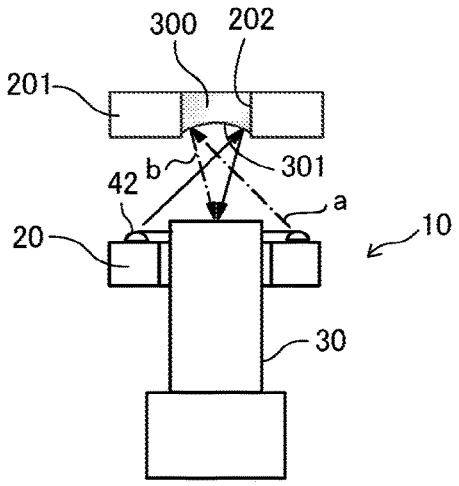
FIG. 14 is a schematic cross-sectional front view of the liquid surface imaging device when the liquid surface imaging device images the liquid surface in the nozzle of the liquid discharge head.

A ninth embodiment of the present disclosure is described with reference to FIGS. 14 and 13. FIG. 13A is a schematic plan view of the liquid surface imaging device 10 according to the ninth embodiment of the present disclosure. FIG. 13B is a schematic cross-sectional front view of the liquid discharge apparatus of FIG. 13A. FIG. 14 is a schematic cross-sectional front view of the liquid surface imaging device 10 when the liquid surface imaging device 10 images a liquid surface in the nozzle 202 of the head 200.

The liquid surface imaging device 10 includes an irradiator 20 and an imaging device 30. The irradiator 20 includes one belt-shaped (annular) lighting 42 to irradiate the liquid surface 301 (meniscus surface) of the liquid 300 held inside the nozzle 202 with a light. The nozzle 202 is formed in the nozzle plate 201 (see FIG. 14) of the head 200 (see FIG. 31). The imaging device 30 images the liquid surface 301 of the liquid 300 in the nozzle 202.

The irradiator 20 includes one continuously belt-shaped (annular) lighting 42 in the holder 21. The belt-shaped (annular) lighting 42 is annular and includes an absence portion 43 in a part of the belt-shaped (annular) lighting 42. The lighting 42 is arranged point-asymmetrically with the center 30*a* (optical axis) of the imaging device 30 as a point of symmetry. Thus, the belt-shaped lighting 42 has a shape point-asymmetrically with the center 30*a* of the imaging device 30 as a point of symmetry.

Specifically, the lighting 42 is arranged point-asymmetrically with the center 30*a* (optical axis) as a point (center) of symmetry when the imaging device 30 is viewed in an imaging direction (viewed in a vertical direction from above in FIG. 13B). If the imaging device 30 includes a lens 33, the center 30*a* can also be referred to as "a symmetry axis passing through a center of the lens 33 (optical imaging system)".

The lighting 42 is a part that is turned on to emit a light. The lighting 42 itself may include a tube-like light source. Alternatively, the liquid surface imaging device 10 may include a lens, a mirror, a prism, an optical fiber, or the like to transmit light emitted from the separately arranged light source to the lighting 42.

Particularly, the liquid surface imaging device 10 has a configuration in which the light emitted from the light source is transmitted to the lighting 42 via the mirror. Thus, the liquid surface imaging device 10 can prevent the liquid dropped from the head 200 from attaching the irradiator 20 and the imaging device 30.

The imaging device 30 includes an imaging element 32 and a lens 33. The imaging element 32 is arranged inside a housing 31 and images the liquid surface 301. The lens 33 is arranged on a front surface (upper surface in FIG. 1B) of the housing 31 to collect lights reflected from the liquid surface 301 (see FIG. 2).

Figure 15A:
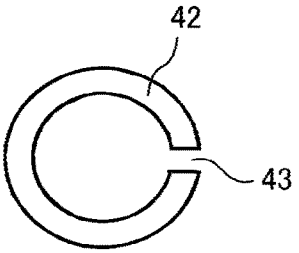
FIGS. 15A to 15C are schematic plan views of the imaging results imaged by the liquid surface imaging device to illustrate the operation of the liquid surface imaging device according to the ninth embodiment.
Figure 15B:
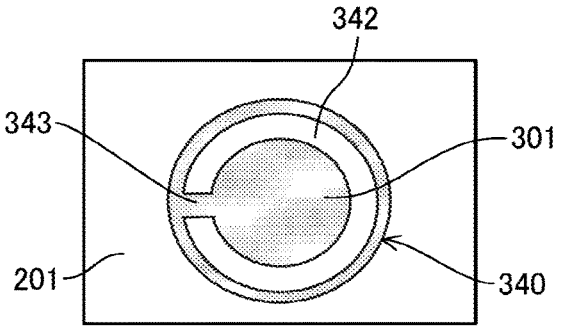
Figure 15C:
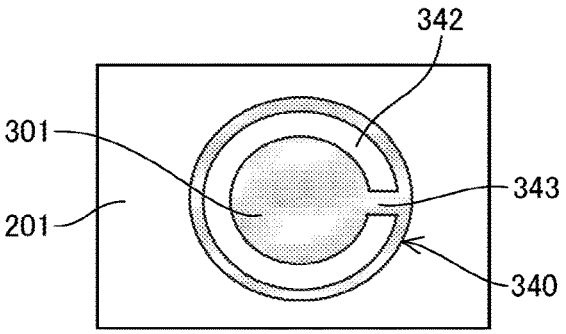

Next, an operation of the liquid surface imaging device 10 is described with reference to FIGS. 15A to 15C. FIGS. 15A to 15C are schematic plan views of imaging results imaged by the liquid surface imaging device 10 to illustrate the operation of the liquid surface imaging device 10 according to the ninth embodiment.

The liquid surface imaging device 10 faces the liquid surface 301 in the nozzle 202 as illustrated in FIG. 14 to image the liquid surface 301 in the nozzle 202. However, the liquid surface imaging device 10 is not necessarily to face the liquid surface 301 to image the liquid surface 301.

The liquid surface imaging device 10 turns on the belt-shaped (annular) lighting 42 of the irradiator 20 to irradiate (illuminates) the liquid surface 301 with light "a" (see FIG. 14) emitted from the lighting 42. A reflected light "b" (see FIG. 14) enters the imaging element 32 via the lens 33 of the imaging device 30 (see FIG. 1B).

For example, as illustrated in FIG. 15A, the liquid surface imaging device 10 turns on the belt-shaped (annular) lighting 42 including the absence portion 43 in a part (right side in FIG. 15A) of the lighting 42. Thus, as illustrated in FIG. 15B, the liquid surface imaging device 10 can obtain an image 340 including an optical image 342 corresponding to the lighting 42 on the liquid surface 301. The image 340 in FIG. 15B is an image when the liquid surface 301 has a concave shape. As illustrated in FIG. 15B, an absence portion 343 (left side in FIG. 15B) in the image 340 is disposed opposite (inverted) to the absence portion 43 of the irradiator 20 (right side in FIG. 15A).

A shape and a size of the optical image 342 in the image 340 change according to a shape and a curvature of the liquid surface 301, a state of the liquid surface 301 such as a solidification of the liquid 300 around a periphery of the nozzle 202.

Thus, the liquid surface imaging device 10 according to the ninth embodiment can obtain the image 340 with the imaging device 30 to observe and grasp the state of the liquid surface 301.

Further, the belt-shaped (annular) lighting 42 has a shape that is point-asymmetrically with the center 30*a* (optical axis) of the imaging device 30 as the point (center) of symmetry according to the ninth embodiment of the present disclosure (see FIG. 15A). That is, the lighting 42 includes the absence portion 43.

Therefore, the absence portion 343 in the image 340 imaged by the imaging device 30 is disposed opposite to the absence portion 43 of the irradiator 20 as illustrated in FIGS. 15A and 15B when the liquid surface 301 has a concave shape. Conversely, when the liquid surface 301 has a convex shape, the absence portion 343 in the image 340 and the absence portion 43 of the irradiator 20 are disposed at the same side (right side in FIGS. 15A and 15C) as illustrated in FIG. 15C.

Thus, the liquid surface imaging device 10 can determine whether the shape of the liquid surface 301 is concave or convex from the position of the absence portion 343 in the image 320. The head 200 cannot perform a normal discharge operation when the liquid surface 301 has a convex shape as illustrated in the liquid surface 301B in FIG. 4(*b*).

Figure 16:
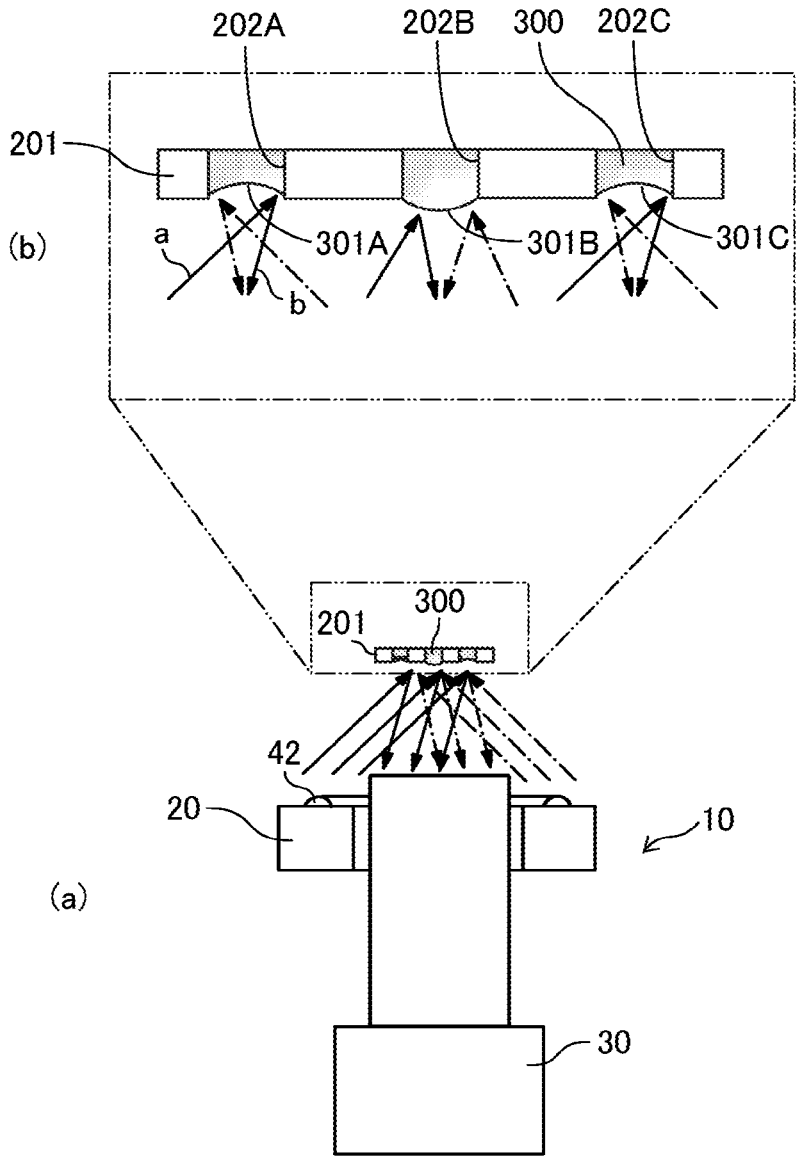
FIG. 16 is a cross-sectional view of the liquid discharge head and the liquid surface imaging device to illustrate an operation of the liquid surface imaging device when a nozzle plate of the liquid discharge head includes a plurality of nozzles.
Figure 17A:
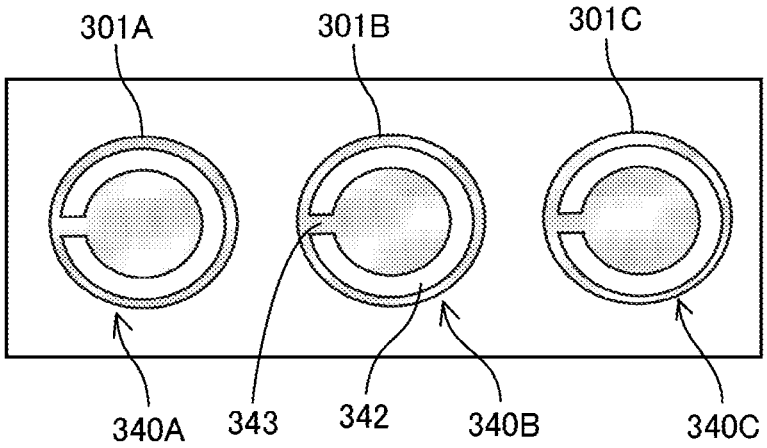
FIGS. 17A and 17B are schematic plan views of the imaging results imaged by the liquid surface imaging device to illustrate the operation of the liquid surface imaging device of FIG. 16.

Next, an imaging operation for the head 200 including the nozzle plate 201 that includes a plurality of nozzles 202 is described with reference to FIGS. 16 and 17. FIG. 16 is a schematic cross-sectional front view of the head 200 and the liquid surface imaging device 10 to illustrate the imaging operation. FIGS. 17A and 17B are schematic plan views of imaging results imaged by the liquid surface imaging device 10 to illustrate the operation of the liquid surface imaging device 10 of FIG. 16.

As illustrated in FIG. 16(*a*), the lighting 42 of the irradiator 20 of the liquid surface imaging device 10 emits the lights "a" so that the liquid surfaces 301A to 301C in the plurality of (three in FIG. 16(*a*)) nozzles 202A to 202C, respectively, are irradiated with the lights "a" as illustrated in FIG. 16(*b*). The reflected lights "b" reflected from each of the liquid surfaces 301A to 301C enter the imaging element 32 of the imaging device 30 (see FIG. 1B).

If the liquid surfaces 301A to 301C in three nozzles 202A to 202C are all concave shape (see liquid surfaces 301A and 301C in FIG. 16(*b*)), all of the absence portions 343 in the images 340A to 340C (see FIG. 17A) are disposed opposite to the absence portion 43 of the irradiator 20 (see FIG. 15A). The position of the absence portions 343 in the images 340A to 340C are at the same side (left side) in FIG. 17A.

Figure 17B:
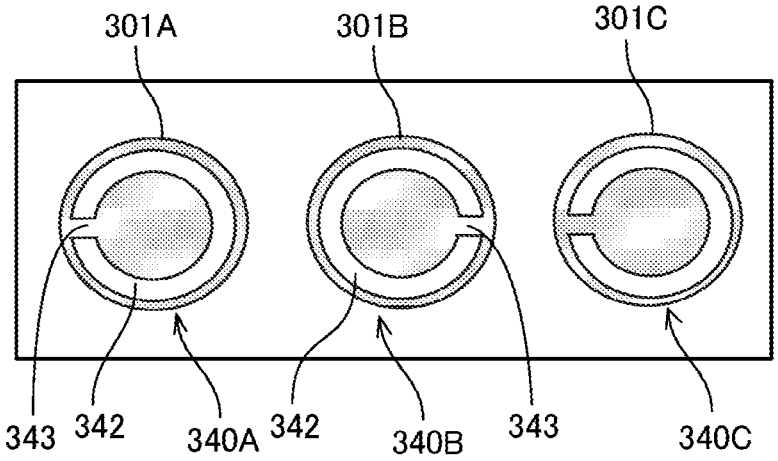

Conversely, if the liquid surface 301B of the nozzle 202B in the middle of the nozzles 202A to 202C is a convex shape (see liquid surface 301B in FIG. 16(*b*)), the absence portions 343 in the image 340B and the absence portion 43 (see FIG. 15A) of the irradiator 20 are disposed at the same side (right side) as illustrated in FIG. 17B. The position of the absence portion 343 in the image 340B (right side) is different from the positions of the absence portions 343 in the images 340A and 340C (left side) in FIG. 17B.

Thus, the liquid surface imaging device 10 according to the first embodiment is used to enable imaging and observation of the state of the liquid surface 301 in the plurality of nozzles 202 at one time.

Figure 18A:
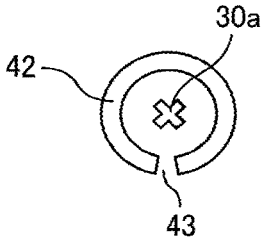
FIGS. 18A to 18C are schematic plan views of different examples of the irradiator of the liquid surface imaging device according to a tenth embodiment of the present disclosure.
Figure 18B:
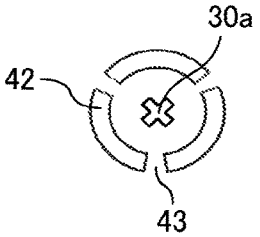
Figure 18C:
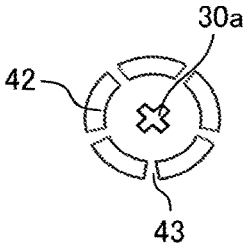

Next, a different example of the liquid surface imaging device 10 in a tenth embodiment of the present disclosure is described with reference to FIGS. 18A to 18C. FIGS. 18A to 18C are schematic plan views of different examples of the irradiator of the liquid surface imaging device 10 according to the tenth embodiment of the present disclosure.

A first example illustrated in FIG. 18A is an example including one annular belt-shaped lighting 42 including an absence portion 43 as in the ninth embodiment (see FIG. 15A). The absence portion 43 is disposed at lower end in the lighting 42 in FIG. 18A. Since one annular belt-shaped lighting 42 has a shape having the absence portion 43, the lighting 42 is arranged point-asymmetrically with the center 30*a* (optical axis) of the imaging device 30 even if the center 30*a* is at any position in the liquid surface imaging device 10. In FIG. 18A, the center 30*a* is at the center of the liquid surface imaging device 10.

In a second example in FIG. 18B and a third example in FIG. 18C, a plurality of belt-shaped lightings 42 are arranged annularly around the center 30*a*. In the second example illustrated in FIG. 18B, the irradiator 20 includes three lightings 42 so that three absence portions 43 arranged in a point-asymmetrical positions. In the third example illustrated in FIG. 18C, the irradiator 20 includes three or five lightings 42 so that five absence portions 43 arranged in the point-asymmetrical positions.

Next, different examples of the liquid surface imaging device 10 in an eleventh embodiment of the present disclosure is described with reference to FIGS. 19A to 19D. FIGS. 19A to 19D are schematic plan views of different examples of the liquid surface imaging device 10 according to the eleventh embodiment of the present disclosure.

Figure 19A:
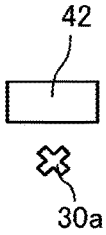
FIGS. 19A to 19D are schematic plan views of different examples of the irradiator of the liquid surface imaging device according to an eleventh embodiment of the present disclosure.

The first example of FIG. 19A is an example including one belt-shaped lighting 42 having a rectangular shape. Since the irradiator 20 includes one belt-shaped lighting 42, the lighting 42 is arranged point-asymmetrically with the center 30*a* (optical axis) of the imaging device 30 even if the center 30*a* is at any position in the liquid surface imaging device 10. In FIG. 18A, the center 30*a* of the imaging device 30 is a point of symmetry.

Figure 19B:
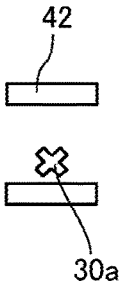
Figure 19C:
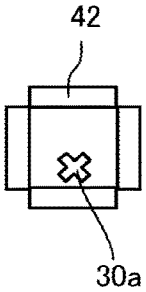
Figure 19D:
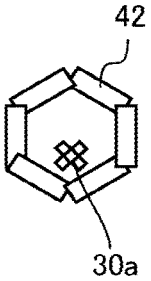

In a second example to a fourth example respectively illustrated in FIGS. 19B to 19D, the plurality of belt-shaped lightings 42 are arranged in point symmetry. However, in each of the second example to the sixth example, the point of symmetry of the plurality of belt-shaped lighting 42 is shifted from the center 30*a* of the imaging device 30. Thus, the plurality of belt-shaped lightings 42 is arranged point-asymmetrically with the center 30*a* (optical axis) of the imaging device 30 as the point of symmetry.

Two lightings 42 are arranged in parallel with the center 30*a* disposed between the two lightings 42 in the second example in FIG. 19B. Four lightings 42 are arranged in a tetragon in the third example in FIG. FIG. 19C. Six lightings 42 are arranged in a hexagon in the fourth example in FIG. 19D.

Figure 20A:
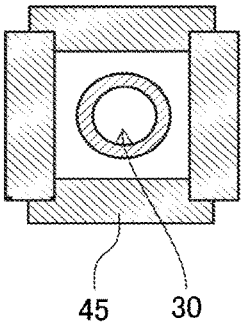
FIGS. 20A to 20C are schematic plan views of the liquid surface imaging device according to a twelfth embodiment of the present disclosure.
Figure 20B:
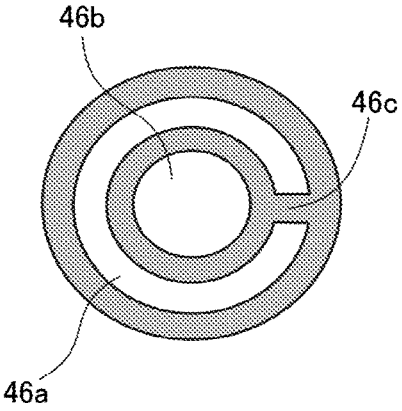
Figure 20C:
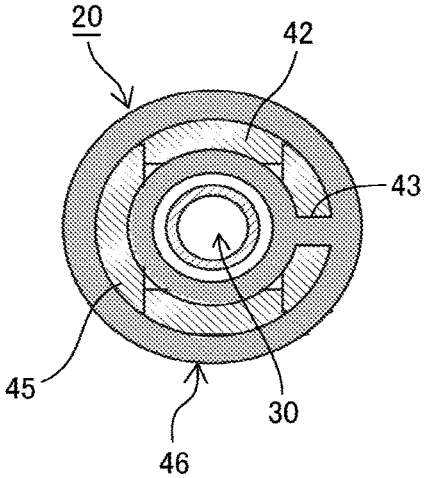

Next, a twelfth embodiment of the present disclosure is described with reference to FIGS. 20A to 20C. FIGS. 20A to 20C are schematic plan views of the liquid surface imaging device 10 according to the twelfth embodiment of the present disclosure.

In the twelfth embodiment, the irradiator 20 includes four light sources 45 (light emitters) arranged in a rectangular shape as illustrated in FIG. 20A. As illustrated in FIGS. 20B and 20C, the irradiator 20 includes a mask 46 including mask portions 46*a* to 46*c* to mask a portion other than a portion having a shape of the annular belt-shaped lighting 42 that includes the absence portion 43 (see FIG. 15A).

Therefore, as illustrated in FIG. 20C, the mask 46 is overlapped on the light source 45 to form one annular belt-shaped lighting 42 including the absence portion 43.

The irradiator 20 in the twelfth embodiment does not have to have an asymmetrical shape or annular shape. Thus, it is improved a degree of freedom in selection of the shape of the irradiator 20. Further, there are advantages in a layout of arrangement of the irradiator 20 and a cost of the irradiator 20.

Figure 21A:
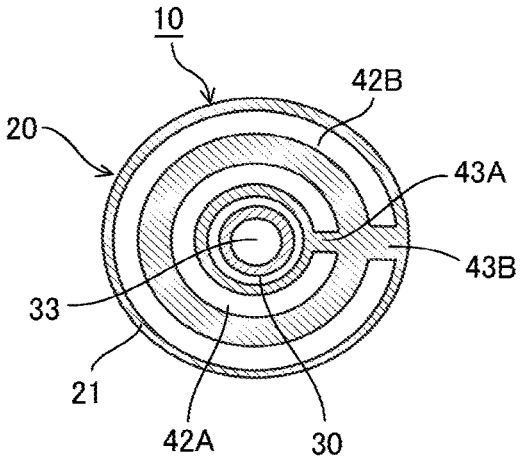
FIGS. 21A and 21B are schematic plan view and side view, respectively, of the liquid surface imaging device according to a thirteenth embodiment of the present disclosure.
Figure 21B:
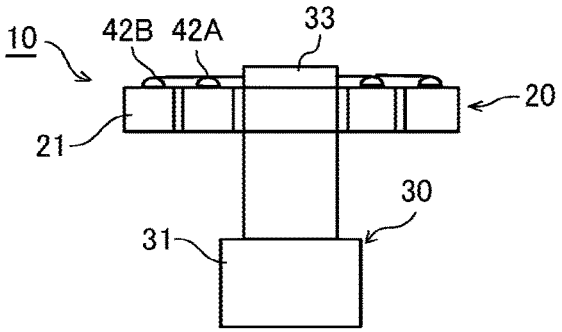
Figure 22A:
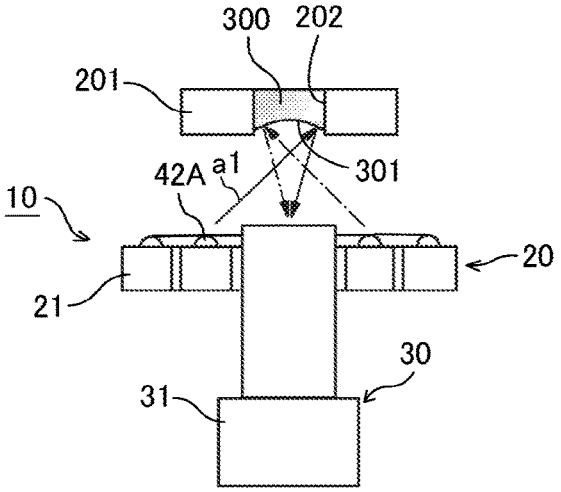
FIGS. 22A and 22B are schematic cross-sectional front views of the liquid surface imaging device when the liquid surface imaging device of FIGS. 21A and 21B images the liquid surface in the nozzle of the liquid discharge head.
Figure 22B:
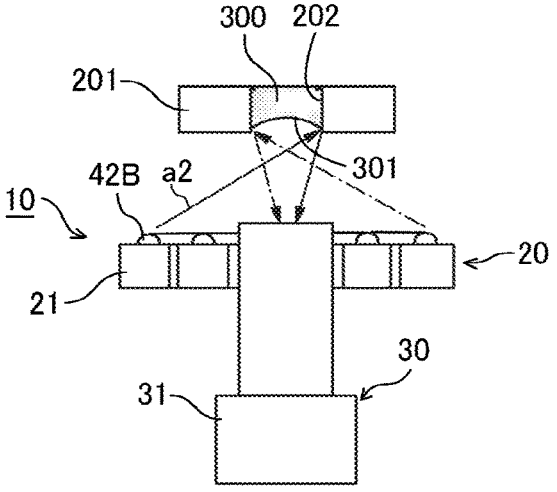
Figure 23:
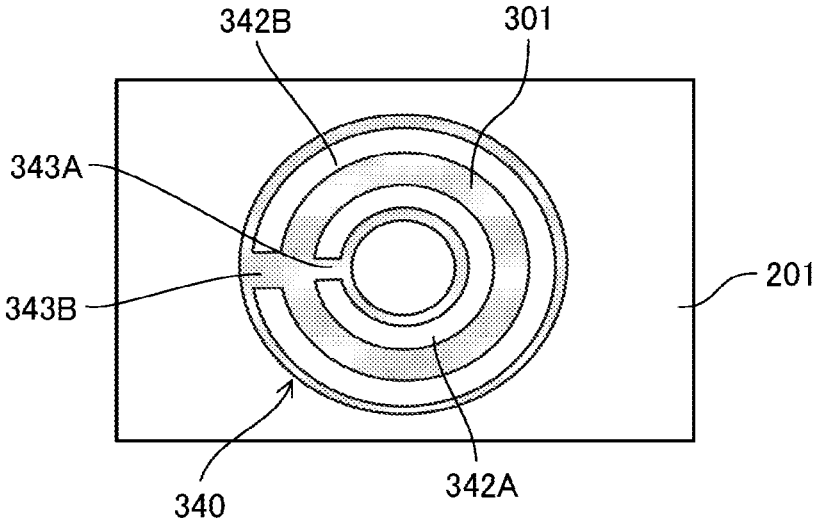
FIG. 23 is a schematic plan view of the imaging result imaged by the liquid surface imaging device to illustrate the operation of the liquid surface imaging device of FIGS. 21A and 21B.

A thirteenth embodiment of the present disclosure is described with reference to FIGS. 21A and 21B, 22A and 22B, and 23. FIG. 21A is a schematic plan view of the liquid surface imaging device 10 according to the thirteenth embodiment of the present disclosure. FIG. 13B is a schematic cross-sectional front view of the liquid discharge apparatus of FIG. 13A. FIGS. 22A and 22B are schematic cross-sectional front views of the liquid surface imaging device 10 when the liquid surface imaging device 10 images a liquid surface in the nozzle 202 of the head 200. FIG. 23 is a schematic plan view of imaging result imaged by the liquid surface imaging device 10 to illustrate the operation of the liquid surface imaging device 10 of FIGS. 21A and 21B, and 22A and 22B.

The irradiator 20 according to the thirteenth embodiment includes the annular lightings 42A and 42B respectively including the absence portions 43A and 43B. The annular lightings 42A and 42B are arranged concentrically. Thus, the irradiator 20 includes two or more lightings 42A and 42B arranged concentrically in a radial direction with the point of symmetry (center 30*a*) of the imaging device 30 as a starting point. The center 30*a* of the imaging device 30 is the point of symmetry.

The liquid surface imaging device 10 thus configured emits light "a1" from the lighting 42A arranged inside the lighting 42B to the liquid surface 301 in the nozzle 202 of the head 200. A reflected light of the light "a1" reflected from the liquid surface 301 enters the imaging device 30 as illustrated in FIG. 22A. Further, the liquid surface imaging device 10 emits light "a2" from the lighting 42B arranged outside the lighting 42A to the liquid surface 301 in the nozzle 202 of the head 200. A reflected light of the light "a2" reflected from the liquid surface 301 enters the imaging device 30 as illustrated in FIG. 22B.

Thus, as illustrated in FIG. 23, the liquid surface imaging device 10 can obtain an image 340 including an optical image 342A corresponding to the lighting 42A and an optical image 342B corresponding to the lighting 42B on the liquid surface 301. The images 340 correspond to the lightings 42A and 42B when the liquid surface 301 has a concave shape. The optical image 342A includes an absence portion 343A, and the optical image 342B includes an absence portion 343B. In FIG. 23, the absence portions 343A and 343B are disposed at the same side (left side) of the optical images 342A and 342B, respectively.

The liquid surface imaging device 10 thus configured can obtain information of the liquid surface 301 at two places of the lightings 42A and 42B in the radial direction of the nozzle 202. For example, the liquid surface imaging device 10 can obtain a curvature of the liquid surface 301 from a positional relationship between the two places of the lightings 42A and 42B.

Figure 24:
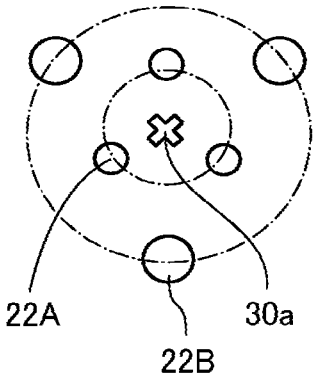
FIG. 24 is a schematic plan view of the irradiator of the liquid surface imaging device according to a fourteenth embodiment of the present disclosure.

Next, a fourteenth embodiment of the present disclosure is described with reference to FIG. 24. FIG. 24 is a schematic plan view of the liquid surface imaging device 10 according to the fourteenth embodiment of the present disclosure.

The liquid surface imaging device 10 according to the fourteenth embodiment is similar to the liquid surface imaging device 10 according to the second example of the seventh embodiment as illustrated in FIG. 11(*b*) in which the irradiator 20 includes three lightings 22 arranged in a triangle. The irradiator 20 according to the fourteenth embodiment includes inner lightings 22A and outer lightings 22B arranged concentrically.

Each of the inner lightings 22A and the outer lightings 22B has a polygonal shape (triangle in FIG. 24) that is point-asymmetrically with the center 30*a* (optical axis) of the imaging device 30 as the point of symmetry. A position of a base of a triangle formed by the inner lightings 22A (lower part in FIG. 24) is disposed opposite to a position of a base of a triangle formed by the outer lightings 22B (upper part in FIG. 24).

Figure 25A:
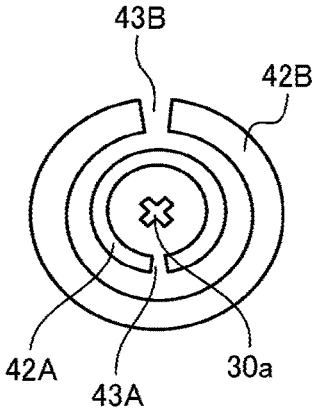
FIGS. 25A to 25C are schematic plan views of different examples of the irradiator of the liquid surface imaging device according to a fifteenth embodiment of the present disclosure.
Figure 25B:
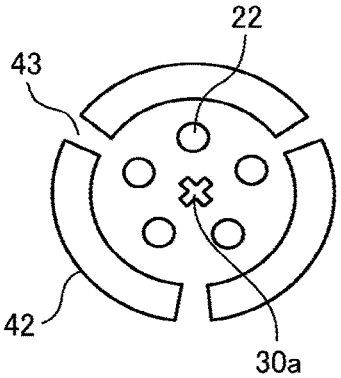
Figure 25C:
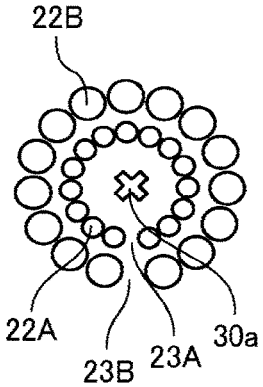

Next, different examples of the liquid surface imaging device 10 in a fifteenth embodiment of the present disclosure is described with reference to FIGS. 25A to 25C. FIGS. 25A to 25C are schematic plan views of the liquid surface imaging device 10 according to the fifteenth embodiment of the present disclosure.

Similar to the thirteenth embodiment as illustrated in FIG. 21A, the irradiator 20 according to the fifteenth embodiment includes two or more lightings 42A and 42B arranged concentrically in the radial direction from the point of symmetry (center 30*a*) of the imaging device 30 as the starting point. Each of the inner lighting 42A and the outer lighting 42B are annular.

In a first example illustrated in FIG. 25A, the liquid surface imaging device 10 includes an inner lighting 42A and an outer lighting 42B disposed outside the inner lighting 42A. The inner lighting 42A surrounds the center 30*a*, and the outer lighting 42B surrounds the inner lighting 42A. The inner lighting 42A includes an absence portion 43A, the outer lighting includes an absence portion 43B. The absence portion 43A is disposed opposite to the absence portion 43B. Specifically, the absence portion 43A is disposed in a bottom portion of the inner lighting 42A, and the absence portion 43B is disposed in a top portion of the outer lighting 42B.

In a second example illustrated in FIG. 25B, the liquid surface imaging device 10 includes a plurality of (five in FIG. 25B) lightings 22 arranged in a polygonal shape (here, pentagonal shape). Further, the liquid surface imaging device 10 includes a plurality of (three in FIG. 25B) annular belt-shaped lightings 42 arranged outside the polygonal lightings 22.

In a third example in FIG. 25C, a plurality of lightings 22A (inner lightings) are arranged annularly around the center 30*a*. Further, a plurality of lightings 22B (outer lightings) are arranged annularly around the lightings 22A arranged annularly. A size of each of the plurality of lightings 22B is larger than a size of each of the plurality of lightings 22A. The plurality of lightings 22A (inner lightings) includes an absence portion 23A, and the plurality of lightings 22B (outer lightings) includes an absence portion 23B. The absence portion 23A and the absence portion 23B are disposed at the same side (lower side) in FIG. 25C. The absence portion 43 may have a structure similar to a structure described in the second to fourth embodiments.

Thus, the irradiator 20 includes at least one lighting (42A, 22, and 22A), and the at least one lightning (42A, 22, and 22A) and the plurality of lightnings (42B, 42, and 22B) are arranged concentrically in a radial direction with the center 30*a* of the imaging device 10 as the point of symmetry.

Figure 26A:
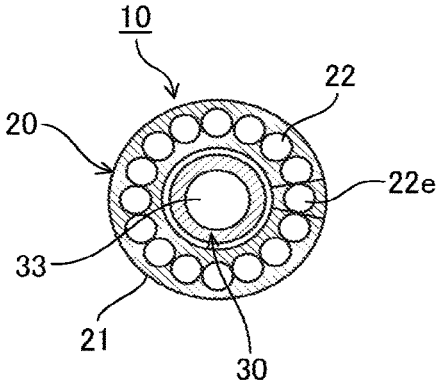
FIGS. 26A and 26B are schematic plan view and side view, respectively, of the liquid surface imaging device according to a sixteenth embodiment of the present disclosure.
Figure 26B:
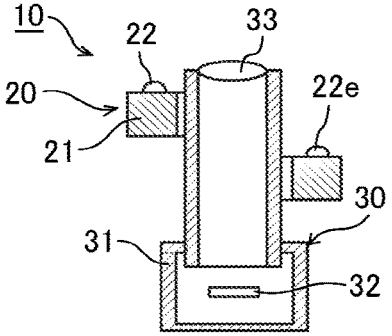

Next, a sixteenth embodiment of the present disclosure is described with reference to FIGS. 26A and 26B. FIG. 26A is a schematic plan view of the liquid surface imaging device 10 according to the sixteenth embodiment of the present disclosure. FIG. 26B is a schematic cross-sectional front view of the liquid surface imaging device 10 of FIG. 26A.

The liquid surface imaging device 10 in the sixteenth embodiment includes a lighting 22*e* that is a part of the plurality of lightings 22. The lighting 22*e* is disposed farther (lower in FIG. 26B) from the nozzle 202 (liquid surface 301) than the other plurality of lightings 22 in an irradiation direction (vertical direction in FIG. 26B) of the light emitted from the plurality of lightings 22. As illustrated in FIG. 26B, the lighting 22*e* is disposed lower than the plurality of lightings 22 (father from the lens 33 and closer to the imaging device 30 than the plurality of lightings 22).

Since the part of lighting 22*e* is arranged farther from the liquid surface 301 than the plurality of lightings 22 as illustrated in FIG. 26B, an amount of light emitted from the lighting 22*e* becomes relatively smaller (darker) than an amount of light emitted from the plurality of lightings 22. Thus, the irradiator 20 can irradiate the liquid surface 301 in the nozzle 202 with light that is point-asymmetrically arranged.

Figure 27:
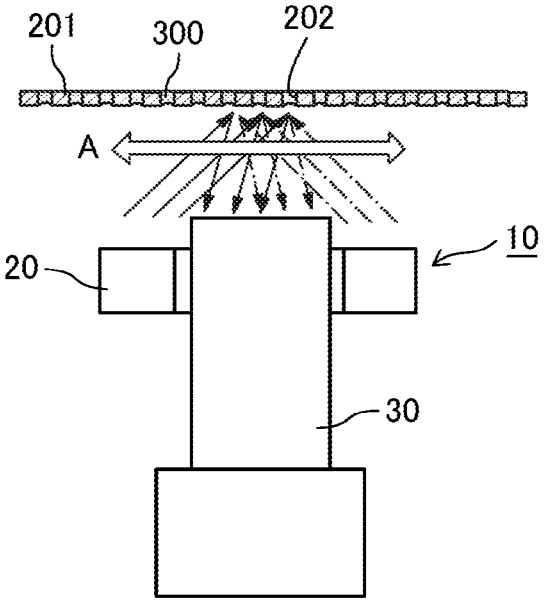
FIG. 27 is a schematic cross-sectional front view of the liquid surface imaging device according to a seventeenth embodiment of the present disclosure.

Next, a seventeenth embodiment of the present disclosure is described with reference to FIG. 27. FIG. 27 is a schematic front view of the liquid surface imaging device 10 according to the seventeenth embodiment.

The liquid surface imaging device 10 according to the seventeenth embodiment moves relative to the nozzle plate 201 in a nozzle array direction as indicated by arrow "A" in FIG. 27. The nozzle plate 201 includes a plurality of the nozzles 202 arrayed in the nozzle array direction.

Thus, the liquid surface imaging device 10 according the seventeenth embodiment can observe a larger number of liquid surfaces 301 in the nozzles 202.

Figure 28:
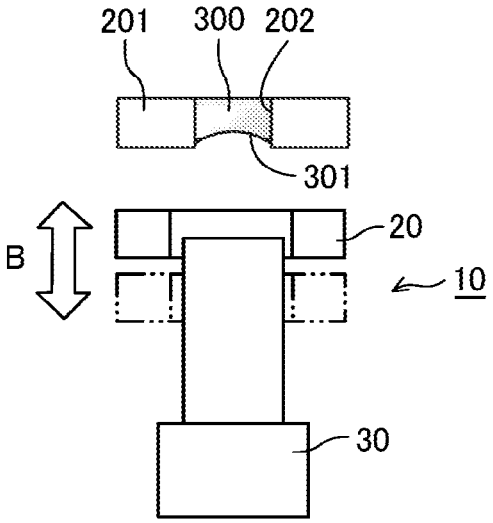
FIG. 28 is a schematic cross-sectional front view of the liquid surface imaging device according to an eighteenth embodiment of the present disclosure.
Figure 29:
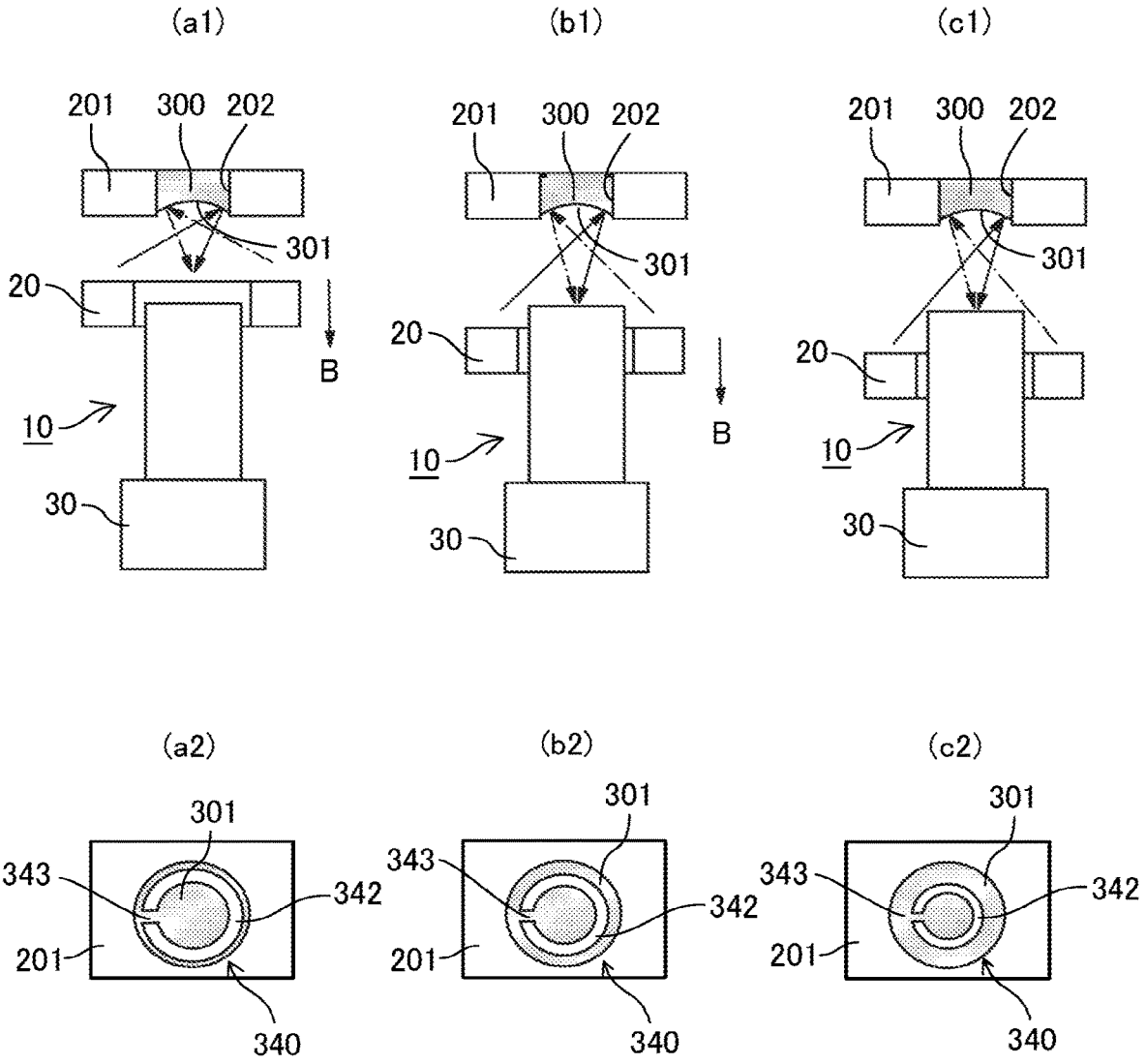
FIG. 29 is a schematic cross-sectional front view of the liquid surface imaging device to illustrate the operation of the liquid surface imaging device of FIG. 28.

Next, an eighteenth embodiment of the present disclosure is described with reference to FIGS. 28 and 29(*a*1) to 29(*c*1). FIG. 28 is a schematic front view of the liquid surface imaging device 10 according to the eighteenth embodiment. FIGS. 29(*a*) to 29(*c*) are schematic front views of the liquid surface imaging device 10 according to the eighteenth embodiment illustrating an imaging operation. FIGS. 29(*a*2) to 29(*c*2) are schematic plan views of the liquid surface imaging device 10 according to the eighteenth embodiment illustrating images 340 on the liquid surface 301.

The liquid surface imaging device 10 according to the eighteenth embodiment includes the irradiator 20 that is movable toward or away from the nozzle plate 201 (liquid surface 301) as an imaging target in a direction (vertical direction) indicated by arrow "B" in FIG. 28. The irradiator 20 (plurality of lightings 22) is arranged in a periphery of the imaging device 30.

The liquid surface imaging device 10 thus configured can obtain the image 340 having the largest optical image 342 as illustrated in FIG. 29(*a*2) among the optical images 342 illustrated in FIGS. 29(*a*2) to 29(*c*2) when the irradiator 20 is closest to the liquid surface 301 as illustrated in FIG. 29(*a*1), for example.

The liquid surface imaging device 10 can obtain the image 340 having a medium sized optical image 342 as illustrated in FIG. 29(*b*2) among the optical images 342 illustrated in FIGS. 29(*a*2) to 29(*c*2) when the irradiator 20 is disposed at a medium position illustrated in FIG. 29(*b*1) that is a position between a position illustrated in FIG. 29(*a*1) and a position illustrated in FIG. 29(*c*1) in the vertical direction indicated by an arrow B.

The liquid surface imaging device 10 can obtain the image 340 having the smallest optical image 342 as illustrated in FIG. 29(*c*2) among the optical images 342 illustrated in FIGS. 29(*a*2) to 29(*c*2) when the irradiator 20 is farthest from the liquid surface 301 as illustrated in FIG. 29(*c*1), for example.

In each of the above-described embodiments, the plurality of lightings 22 of the irradiator 20 is arranged in the periphery of the imaging device 30. Thus, the liquid surface imaging device 10 according to the eighteenth embodiment can reduce the size of the liquid surface imaging device 10. However, if the liquid surface 301 is inside an imaging region of the imaging device 30, the reflected light from the liquid surface 301 is incident on the imaging device 30. Thus, the plurality of lightings 22 of the irradiator 20 may not be arranged in a periphery of the imaging device 30.

Figure 30:
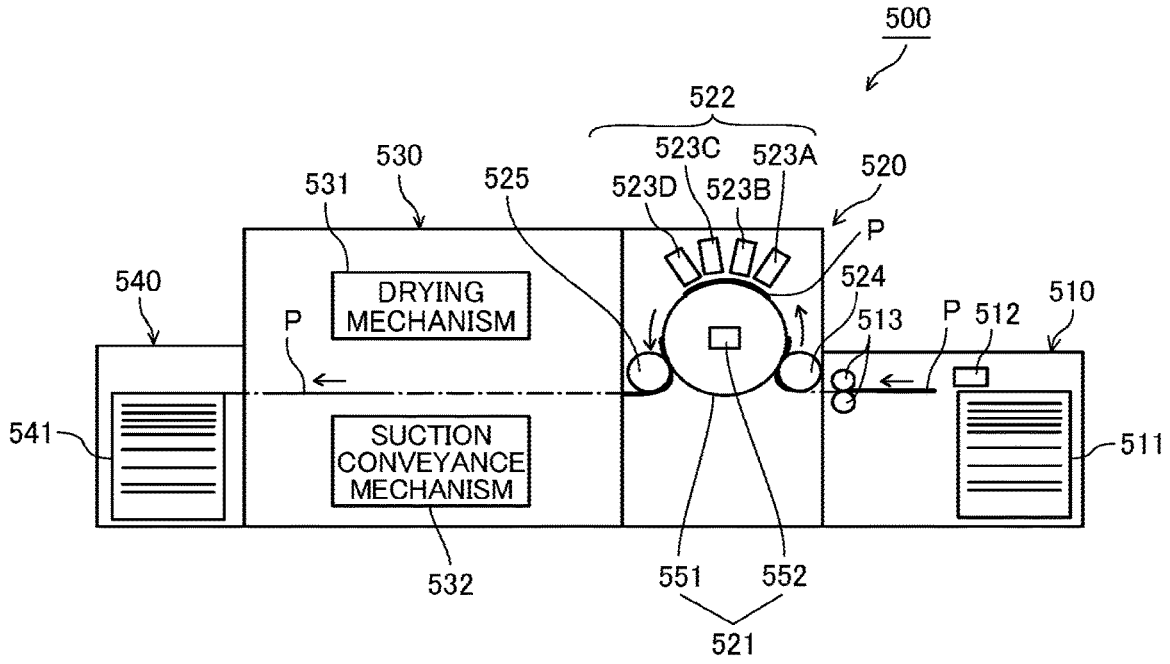
FIG. 30 is a schematic cross-sectional front view of a printer as a liquid discharge apparatus according to a nineteenth embodiment of the present disclosure.
Figure 31:
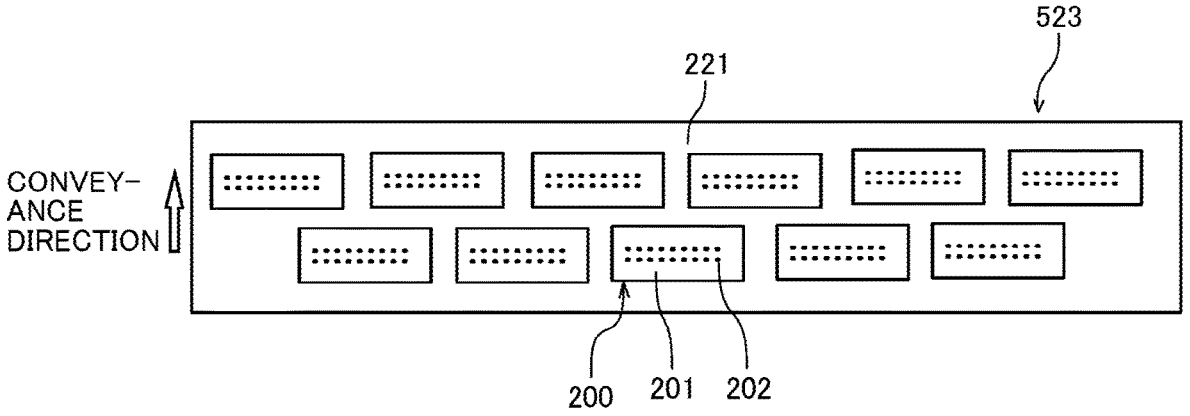
FIG. 31 is a plan view of an example of a head device of the printer of FIG. 30.

Next, a nineteenth embodiment of the present disclosure is described with reference to FIGS. 30 and 31. FIG. 30 is a schematic side view of an example of a printer 500 as a liquid discharge apparatus according to the nineteenth embodiment of the present disclosure. FIG. 31 is a plan view of an example of a discharge unit 523 of the printer 500.

The printer 500 includes a loading device 510, a printing device 520, a drying device 530, and an ejection device 540. The printer 500 applies a liquid to a sheet P conveyed from the loading device 510 by the printing device 520 to perform required printing, dries the liquid adhering to the sheet P by the drying device 530, and ejects the sheet P to the ejection device 540.

The loading device 510 includes a loading tray 511 on which a plurality of sheets P are stacked, a feeding device 512 to separate and feed the sheets P one by one from the loading tray 511, and a resist roller pair 513 to feed the sheet P to the printing device 520.

Any feeder such as a device using a roller or a device using air suction may be used as the feeding device 512. The sheet P delivered from the loading tray 511 by the feeding device 512 is delivered to the printing device 520 by the resist roller pair 513 being driven at a predetermined timing after a leading edge of the sheet P reaches the resist roller pair 513.

The printing device 520 includes a sheet conveyor 521 to convey the sheet P. The sheet conveyor 521 includes a drum 551 and a suction device 552. The drum 551 is a bearer (rotating member) that bears the sheet P on a circumferential surface of the drum 551 and rotates. The suction device 552 generates a suction force on the circumferential surface of the drum 551.

The printing device 520 includes a liquid discharge device 522 that discharges the liquid toward the sheet P carried on the drum 551 of the sheet conveyor 521 to apply the liquid to the sheet P.

The printing device 520 further includes a transfer cylinder 524 and a delivery cylinder 525. The transfer cylinder 524 receives the fed sheet P and transfers the sheet P to the drum 551. The delivery cylinder 525 delivers the sheet P conveyed by the drum 551 to the drying device 530.

The leading end of the sheet P conveyed from the loading device 510 to the printing device 520 is gripped by a sheet gripper provided on a surface of the transfer cylinder 524 and is conveyed in accordance with the rotation of the transfer cylinder 524. The transfer cylinder 524 forwards the sheet P to the drum 551 at a position opposite the drum 551.

The drum 551 also includes the sheet gripper on a surface of the drum 551. The sheet gripper on the drum 551 grips the leading end of the sheet P. A plurality of suction holes are dispersedly formed on the surface of the drum 551. A suction device 552 generates a suction airflow from the plurality of suction holes of the drum 551 toward an interior of the drum 551.

On the drum 551, the sheet gripper grips the leading end of the sheet P forwarded from the transfer cylinder 524, and the sheet P is attracted to and borne on the drum 551 by the suction airflows by the suction device 552. As the drum 551 rotates, the sheet P is conveyed.

The liquid discharge device 522 includes discharge units 523 (523A to 523D) to discharge liquids of each color, for example, yellow (Y), cyan (C), magenta (M), and black (K). For example, the discharge unit 523A discharges a liquid of cyan (C), the discharge unit 523B discharges a liquid of magenta (M), the discharge unit 523C discharges a liquid of yellow (Y), and the discharge unit 523D discharges a liquid of black (K), respectively.

The discharge units 523 may also include a discharge unit that discharges a special liquid such as white or gold (silver), or a treatment liquid such as a surface coating liquid.

The discharge unit 523 is a full line head and includes a plurality of liquid discharge heads 200 (hereinafter simply referred to as "heads 200") arranged in a staggered manner on a base 221. Each of the plurality of heads 200 includes a nozzle plate 201 that includes a plurality of nozzle rows (two rows in FIG. 31). Each of the plurality of nozzles rows in the head 200 includes a plurality of nozzles 202 arrayed in a longitudinal direction of the head 200 illustrated in FIG. 31.

A discharge operation of each of the discharge units 523 of the liquid discharge device 522 is controlled by drive signals corresponding to print information. When the sheet P carried by the drum 551 passes through a region facing the liquid discharge device 522, the liquid of each color is discharged from the discharge units 523, and an image corresponding to the print information is printed on the sheet P.

The drying device 530 includes a drying mechanism 531 and a suction conveyance mechanism 532. The drying mechanism 531 dries the liquid adhered on the sheet P by the printing device 520. The suction conveyance mechanism 532 conveys (attracts and conveys) the sheet P while attracting the sheet P conveyed from the printing device 520.

After the sheet P conveyed from the printing device 520 is received by the suction conveyance mechanism 532, the sheet P is conveyed to pass through the drying mechanism 531 and delivered to the ejection device 540.

When the sheet P passes through the dying mechanism 531, the liquid on the sheet P is subjected to a drying process. Thus, the liquid component, such as water in the liquid evaporates and the colorant contained in the liquid, is fixed on the sheet P. Thus, curling of the sheet P is reduced.

The ejection device 540 includes an ejection tray 541 on which a plurality of sheets P are stacked. The sheets P conveyed from the drying device 530 are sequentially stacked and held on the ejection tray 541.

For example, the printer 500 may include a pre-processing unit to perform pre-processing of image formation on the sheet P. The pre-processing unit is disposed on an upstream of the printing device 520. Further, the printer 500 may include a post-processing unit that performs post-processing on the sheet P, to which the liquid is adhered, between the drying device 530 and the ejection device 540.

For example, the pre-processing unit may perform a pre-application process that applies a treatment liquid on the sheet P before the image formation. The treatment liquid reacts with the liquid to reduce bleeding of the liquid to the sheet P. However, the content of the pre-processing is not particularly limited to the process as described above. Further, the post-processing unit may perform a sheet reversing process and a binding process for binding a plurality of sheets P, for example. The sheet reversing process reverses the sheet P, on which image is printed by the printing device 520, and conveys the reversed sheet P again to the printing device 520 to print on both sides of the sheet P.

The above-described embodiments describe the printer 500 that prints an image on a cut sheet P. However, the printer 500 may also be applied to a printer that prints an image on a continuous material such as continuous paper.

Figure 32:
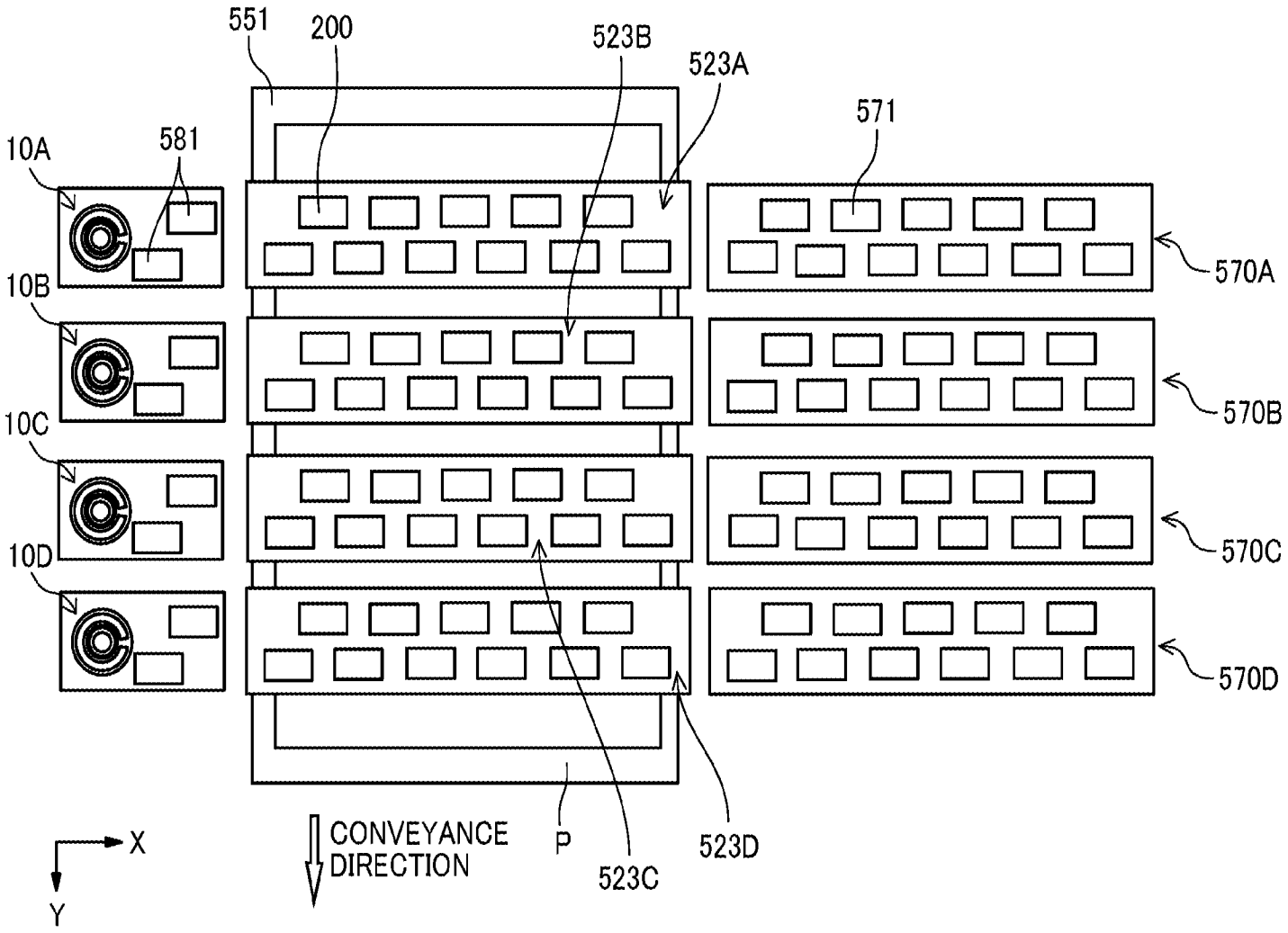
FIG. 32 is a plan view of an example of a printing device of the printer of FIG. 30.

Next, an example of a configuration of the printing device 520 in the printer 500 is described with reference to FIG. 32. FIG. 32 is a plan view of a printing device 520 according to the nineteenth embodiment of the present disclosure.

As described above, the printing device 520 includes the discharge units 523 (523A to 523D) arranged around the drum 551.

The printing device 520 includes a cap device 570 (570A to 570D) including caps 571 to respectively cap the heads 200 of the discharge unit 523. The cap device 570 (570A to 570D) are reciprocally movable in an axial direction of the drum 551 that is a direction indicated by arrow X (X-direction) in FIG. 32. The X-direction is parallel to a head arrangement direction in which the heads 200 are arranged. The X-direction is perpendicular to a conveyance direction (Y-direction) in which the sheet P is conveyed.

When a nozzle surface of the head 200 is capped by the cap 571 of the cap device 570, the discharge unit 523 ascends in a normal direction of the drum 551. The cap device 570 enters a space below the discharge unit 523 (space between the discharge unit 523 and the drum 551), and the discharge unit 523 descends in the normal direction of the drum 551 toward the cap device 570.

Further, the printing device 520 includes a wiping and imaging device 580 that mounts wiping devices 581 and the liquid surface imaging device 10 (10A to 10D) according to the above-described embodiments. The wiping and imaging device 580 is reciprocally movable in the X direction. The wiping devices 581 wipe the nozzle surfaces of the heads 200 of the discharge unit 523.

The discharge unit 523 ascends in the normal direction of the drum 551, and the wiping and imaging device 580 enters the space below the discharge unit 523 (space between the discharge unit 523 and the drum 551) and reciprocally moves in the X-direction to wipe the nozzle surface of the heads 200 with a wiping member such as a web when the wiping devices 581 wipe the nozzle surfaces of the heads 200.

When the liquid surface imaging device 10 images the image 320 on the liquid surface 301, the discharge unit 523 ascends in the normal direction of the drum 551, the wiping and imaging device 580 enters the space below the discharge unit 523 (space between the discharge unit 523 and the drum 551) and reciprocally moves in the X-direction to image the liquid surface 301 by the liquid surface imaging device 10.

Figure 33:
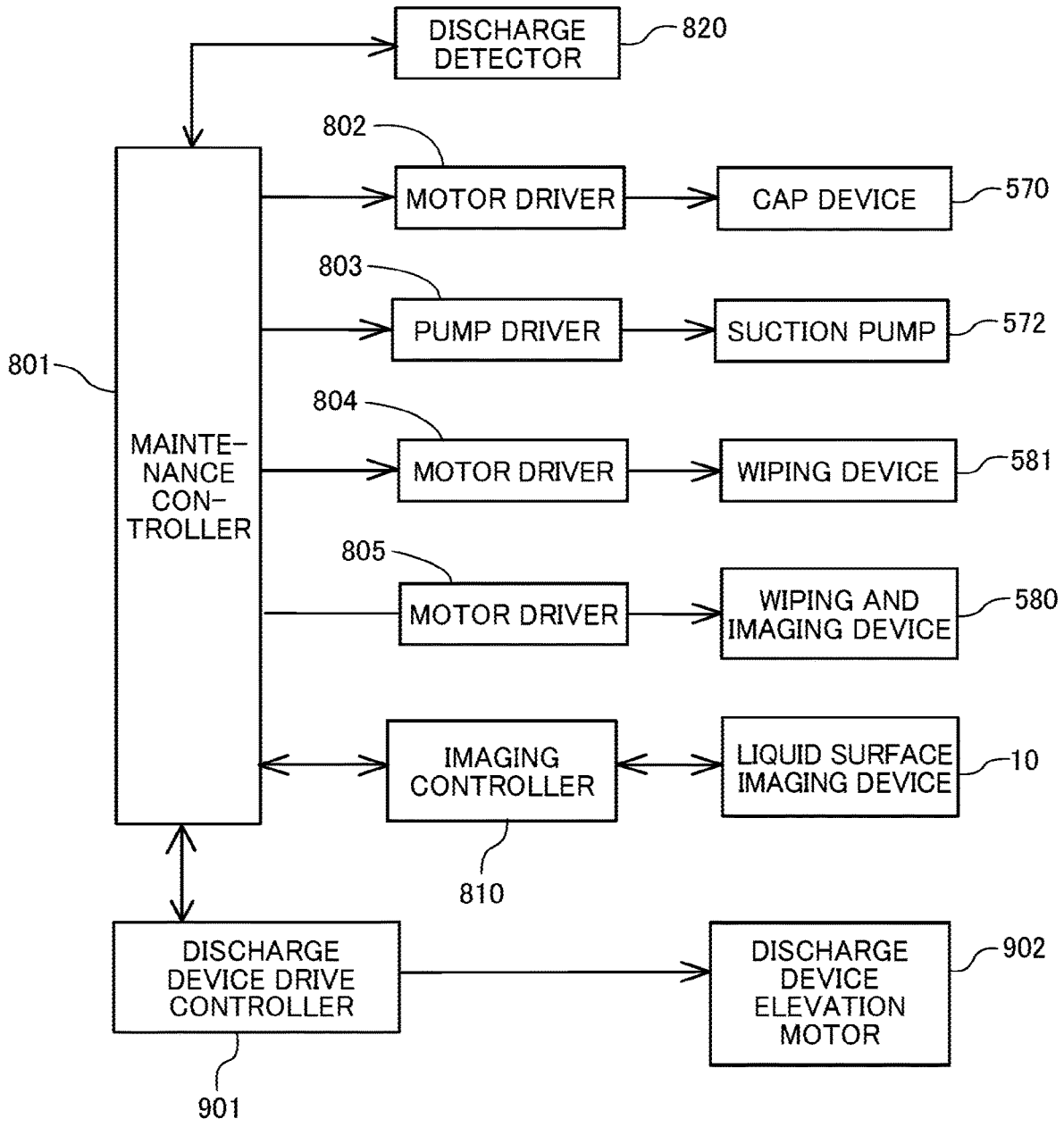
FIG. 33 is a block diagram of an example of a maintenance control of the printer of FIG. 30.

FIG. 33 is a block diagram of an example of a maintenance control of the printer 500 according to an embodiment of the present disclosure.

The printer 500 includes a maintenance controller 801 (circuitry) that controls a maintenance operation performed on the heads 200 in the printer 500. The maintenance controller 801 may be configured as a part of a controller of the printer 500, for example.

The maintenance controller 801 controls a reciprocal movement of the cap device 570 via the motor driver 802 and controls to drive a suction pump 572 connected to the cap 571 via a pump driver 803.

The maintenance controller 801 controls to drive the wiping devices 581 via the motor driver 804. For example, the maintenance controller 801 controls movement of the web in the wiping device 581 via the motor driver 804.

The maintenance controller 801 controls the reciprocal movement of the wiping and imaging device 580 via the motor driver 805.

The maintenance controller 801 instructs the imaging controller 810 to perform an imaging operation and captures the imaging result. The imaging controller 810 controls imaging of the liquid surface 301 by the liquid surface imaging device 10.

The maintenance controller 801 instructs the discharge detector 820 to perform a discharge detection operation and import a discharge detection result. The maintenance controller 801 controls the head 200 to discharge a liquid onto an electrode plate arranged in the cap 571 so that the discharge detector 820 detects a discharge state of the nozzle 202 from an electrical change on the electrode plate, for example.

The maintenance controller 801 controls to drive a discharge device elevation motor 902 that ascends and descends the discharge unit 523 via the discharge device drive controller 901.

Figure 34:
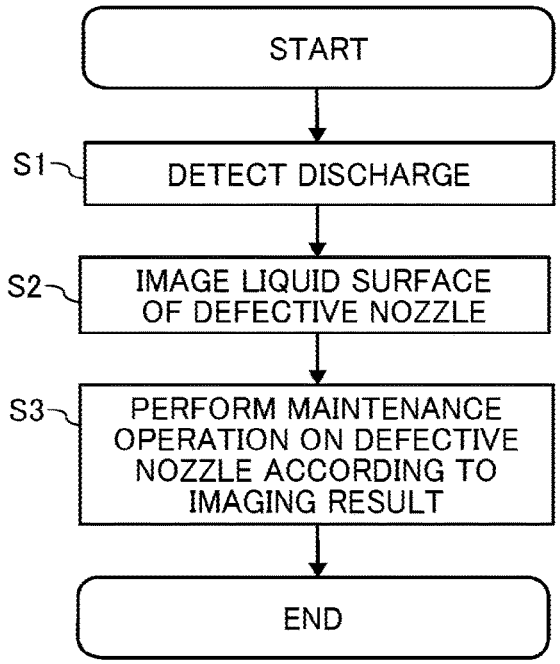
FIG. 34 is a flowchart of an example of control of the maintenance operation by the maintenance controller of the printer of FIG. 30.

FIG. 34 is a flowchart of an example of control of the maintenance operation by the maintenance controller 801 according to the nineteenth embodiment of the present disclosure.

The maintenance controller 801 causes the discharge detector 820 to perform discharge detection for each nozzle 202 of each head 200 of the discharge unit 523 (step S1). Hereinafter, the step S1 is simply referred to as "S1."

The maintenance controller 801 imports the discharge detection result from the discharge detector 820. The maintenance controller 801 determines presence or absence of a defective nozzle 202 (such as a non-discharge nozzle). When the maintenance controller 801 determines that there is the defective nozzle 202, the maintenance controller 801 controls the wiping and imaging device 580 to move below the nozzle 202 and instructs the imaging controller 810 to image the liquid surface 301 of the defective nozzle 202 with the liquid surface imaging device 10. The maintenance controller 801 images the liquid surface 301 of the defective nozzle 202 by the liquid surface imaging device 10 and captures the imaging result (S2).

Then, the maintenance controller 801 selects the maintenance operation according to the imaging result and controls the cap device 570 and the wiping device 581 to execute the maintenance operation (S3).

The maintenance controller 801 may perform a head suction operation (nozzle suction operation) that cause the cap 571 to cap the nozzle surface of the head 200 and further operates the suction pump 572 to suck and discharge the liquid from the nozzle 202 as a head suction operation (nozzle suction operation), for example. Further, the maintenance controller 801 may perform a dummy discharge operation (flushing or purge operation) that cause the head 200 to discharge the liquid from the nozzle 202 toward the cap 571. Further, the maintenance controller 801 may perform a wiping operation to wipe the nozzle surface of the head 200 with the wiping device 581.

The maintenance controller 801 determines a state of the nozzle 202 from the imaging result of the liquid surface 301 of the nozzle 202 and selects and executes the required maintenance operation from the above-described different maintenance operations.

Figure 35:
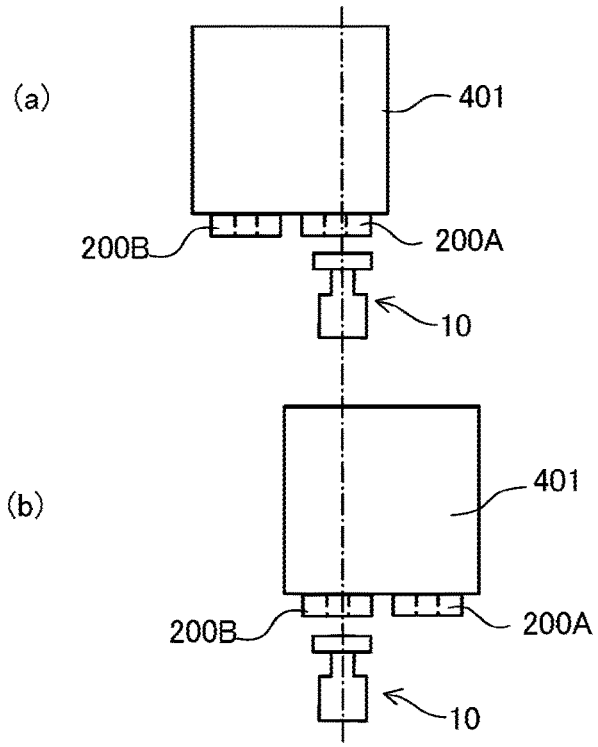
FIG. 35 is a schematic cross-sectional front view of a carriage of the printer which is a liquid discharge apparatus to discharge liquid according a twentieth embodiment of the present disclosure.

A twentieth embodiment of the present disclosure is described with reference to FIG. 35. FIG. 35 is a schematic cross-sectional front view of a carriage 401 of the printer 500 which is a liquid discharge apparatus to discharge liquid according to the twentieth embodiment.

The printer 500 includes the head 200 mounted on a carriage 401. The carriage 401 is reciprocally movable in the X-direction (see FIG. 32).

The maintenance controller 801 moves the carriage 401 relative to the liquid surface imaging device 10 in the X-direction so that the head 200A faces the liquid surface imaging device 10 when the printer 500 images the liquid surfaces 301 in the nozzles 202 of the head 200. Then, the liquid surface imaging device 10 images each of the liquid surfaces 301 in the nozzles 202 of the head 200A. Then, the maintenance controller 801 moves the carriage 401 to a position at which the head 200B faces the liquid surface imaging device 10. Then, the liquid surface imaging device 10 images each of the liquid surfaces 301 in the nozzles 202 of the head 200B.

As described above, the printer 500 according to twentieth embodiment can reciprocally move the carriage 401 in the X-direction so that the liquid surface imaging device 10 faces the liquid surface 301 in the nozzle 202 of the head 200. Thus, the printer 500 can simultaneously irradiate and image a plurality of liquid surfaces 301 in the nozzles 202 of the heads 200.

Further, "liquid" discharged from the head is not particularly limited as long as the liquid has a viscosity and surface tension of degrees dischargeable from the head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source in the head to generate energy to discharge liquid from the head include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The term "liquid discharge apparatus" used herein also represents an apparatus including the head to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material onto which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate. Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell. The "material onto which liquid can adhere" includes any material on which liquid is adhered, unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material onto which liquid can adhere. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions. For example, the maintenance controller 801 (circuitry) as described above may be implemented by one or more processing circuits or circuitry.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid surface imaging device comprising:

an irradiator including a plurality of lightings, the irradiator configured to irradiate a liquid surface in a nozzle of a liquid discharge head with light emitted from the plurality of lightings; and an imaging device configured to image the liquid surface, wherein the plurality of lightings is arranged point-asymmetrically with a center of the imaging device as a point of symmetry.

2. The liquid surface imaging device according to claim 1, wherein the plurality of lightings is arranged in a polygonal shape.

3. The liquid surface imaging device according to claim 1, wherein the plurality of lightings is arranged annularly.

4. The liquid surface imaging device according to claim 1, wherein the plurality of lightings includes a plurality of belt-shaped lightings.

5. The liquid surface imaging device according to claim 4, wherein the plurality of belt-shaped lightings is arranged concentrically.

6. The liquid surface imaging device according to claim 4, wherein the plurality of belt-shaped lightings is arranged in a polygonal shape.

7. The liquid surface imaging device according to claim 4, wherein the plurality of belt-shaped lightings is arranged annularly.

8. The liquid surface imaging device according to claim 1, wherein the plurality of lightings is arranged around a periphery of the imaging device.

9. The liquid surface imaging device according to claim 1, wherein the irradiator is movable toward or away from the liquid surface.

10. The liquid surface imaging device according to claim 1, further comprising:

a light source configured to emit light; and a mirror configured to transmit the light emitted from the light source to the plurality of lightings of the irradiator.

11. The liquid surface imaging device according to claim 1, wherein the irradiator further includes at least one lighting, and the at least one lighting and the plurality of lightings are arranged concentrically in a radial direction with the center of the imaging device as the point of symmetry.

12. A liquid discharge apparatus comprising:

the liquid surface imaging device according to claim 1; and the liquid discharge head including the nozzle, the liquid discharge head configured to discharge a liquid from the nozzle.

13. The liquid discharge apparatus according to claim 12, wherein the nozzle includes a plurality of nozzles, the plurality of nozzles arrayed in a nozzle array direction, and the imaging device is movable relative to the plurality of nozzles in the nozzle array direction.

14. The liquid discharge apparatus according to claim 12, wherein the imaging device images the liquid surface in the nozzle of the liquid discharge head at a position at which the imaging device faces the nozzle.

15. The liquid discharge apparatus according to claim 12, further comprising:

circuitry configured to:

control the liquid surface imaging device to image the liquid surface; and select one of a plurality of maintenance operations to be performed on the liquid discharge head according to an imaging result of the liquid surface imaging device.

16. A liquid surface imaging device comprising:

an irradiator including a plurality of lightings, the irradiator configured to irradiate a liquid surface in a nozzle of a liquid discharge head with light emitted from the plurality of lightings; and an imaging device configured to image the liquid surface, wherein the plurality of lightings is arranged point-symmetrically with a center of the imaging device as a point of symmetry, and the irradiator is configured to individually turn off a part of the plurality of lightings and turn on the other part of the plurality of lightings.

17. The liquid surface imaging device according to claim 16, wherein the irradiator is configured to select the part of the plurality of lightings to be turned off.

18. A liquid discharge apparatus comprising:

the liquid surface imaging device according to claim 16; and the liquid discharge head including the nozzle, the liquid discharge head configured to discharge a liquid from the nozzle.

19. A liquid surface imaging device comprising:

an irradiator including a belt-shaped lighting, the irradiator configured to irradiate a liquid surface in a nozzle of a liquid discharge head with light emitted from the belt-shaped lighting; and an imaging device configured to image the liquid surface, wherein the belt-shaped lighting has a shape point-asymmetric with a center of the imaging device as a point of symmetry.

20. A liquid discharge apparatus comprising:

the liquid surface imaging device according to claim 19; and the liquid discharge head including the nozzle, the liquid discharge head configured to discharge a liquid from the nozzle.

* * * * *